US006244240B1

(12) United States Patent
Mallen

(10) Patent No.: US 6,244,240 B1
(45) Date of Patent: Jun. 12, 2001

(54) ROTARY POSITIVE-DISPLACEMENT SCAVENGING DEVICE FOR ROTARY VANE PUMPING MACHINE

(75) Inventor: Brian D. Mallen, Charlottesville, VA (US)

(73) Assignee: Mallen Research Limited Partnership, Charlotte, VA (US)

( * ) Notice: Subject to any disclaimer, the term of this patent is extended or adjusted under 35 U.S.C. 154(b) by 0 days.

(21) Appl. No.: 09/302,512

(22) Filed: Apr. 30, 1999

(51) Int. Cl.[7] ..... F02B 53/00

(52) U.S. Cl. ..... 123/243; 123/244; 418/227; 60/511

(58) Field of Search ..... 123/243, 244; 418/227, 253, 235; 60/511

(56) References Cited

U.S. PATENT DOCUMENTS 1,743,539 * 1/1930 Gasal .
3,437,079 * 4/1969 Odawara ..... 123/243
3,548,790 * 12/1970 Pitts ..... 123/243
3,923,431 * 12/1975 Abbey ..... 418/61 R
4,432,203 * 2/1984 Fischer ..... 60/511
5,372,107 * 12/1994 Smythe ..... 123/244

FOREIGN PATENT DOCUMENTS

1551150 * 3/1970 (DE) ..... 418/138
356098527A * 8/1981 (JP) .
408246888A * 9/1996 (JP) .

* cited by examiner

*Primary Examiner*—Thomas Denion
*Assistant Examiner*—Thai-Ba Trieu
(74) *Attorney, Agent, or Firm*—Jones Volentine, LLC

(57) ABSTRACT

A rotary vane pumping machine includes a stator and rotor in relative rotation. The rotor has a plurality of radial vanes slots and each one of a corresponding plurality of vanes slides within a radial vane slot of the rotor. Each pair of adjacent vanes defines a vane cell. A rotary scavenging disk is disposed along the stator circumference, and is sized such that the rotary scavenging disk extends into the vane cell. An outer circumferential edge of the rotary scavenging disk is in sealing proximity with an outer circumferential edge of the rotor and recesses within the rotary scavenging disk mesh and seal with the extending and retracting vanes.

16 Claims, 18 Drawing Sheets

ROTARY POSITIVE-DISPLACEMENT SCAVENGING DEVICE FOR ROTARY VANE PUMPING MACHINE

BACKGROUND OF THE INVENTION

1. Field of the Invention

The present invention generally relates to rotary vane pumping machines, and more particularly, to a rotary positive-displacement scavenging device that communicates with the vane cells of the pumping machine to provide versatility in isolating, scavenging, and/or accessing the respective contents of the vane cells to enhance the performance of the rotary vane pumping machine.

2. Description of the Related Art

The overall invention relates to a large class of devices comprising all rotary vane (or sliding vane) pumps, compressors, engines, vacuum-pumps, blowers, and internal combustion engines. Herein the term pumping machine refers to a member of a set of devices including pumps, compressors, engines, vacuum-pumps, blowers, and internal combustion engines. Thus, this invention relates to a class of rotary vane pumping machines.

This class of rotary vane pumping machines includes designs having a rotor with slots with a radial component of alignment with respect to the rotor's axis of rotation, vanes which reciprocate within these slots, and a chamber contour within which the vane tips trace their path as they rotate and reciprocate within their rotor slots.

In alternate embodiments, the vanes may slide with an axial component of vane motion, or with a vector that includes both axial and radial components. The vanes may also be oriented at any angle in or orthogonal to the plane illustrated, whereby the vanes would also slide with a diagonal motion in addition to any axial or radial components. The vane motion may also have an arcuate component of motion as well. In all cases, the reciprocating vanes extend and retract synchronously with the relative rotation of the rotor and the shape of the chamber surface in such a way as to create cascading cells of compression and/or expansion, thereby providing the essential components of a pumping machine.

Some means of radially guiding the vanes is provided to ensure near-contact, or close proximity, between the vane tips and chamber surface as the rotor and vanes rotate with respect to the chamber surface. Certain radial guidance designs were described in pending U.S. patent application Ser. Nos. 08/887,304, to Mallen, filed Jul. 2, 1997, entitled "Rotary-Linear Vane Guidance in a Rotary Vane Pumping Machine" ('304 application); and 09/187,705, to Mallen, filed Nov. 4, 1998, entitled "Rotary-Linear Vane Guidance in a Rotary Vane Pumping Machine" ('705 application). The '304 and '705 applications describe a vane guidance means that overcomes a common shortcoming of the conventional means of guiding the vanes, namely that high linear speeds are encountered at the radial-guidance frictional interface. These high speeds severely limit the maximum speed of operation and thus the maximum flow per given engine size.

In the improved sliding-vane pumping geometry of the '304 and '705 applications, multiple vanes sweep in relative motion against the chamber surfaces, which incorporates a radial-guidance frictional interface operating at a reduced speed compared with the tangential speed of the vanes at the radial location of the interface. The linear translation ring interface permits higher loads at high rotor rotational speeds to be sustained by the bearing surfaces than with conventional designs. Accordingly, much higher flow rates are achieved within a given size pumping device or internal combustion engine, thereby improving the performance and usefulness of these machines.

However, even with the above advantages, efforts continue in order to further refine and enhance the performance of the rotary machine. In particular, for an internal combustion engine application, a two-stroke design achieves very high flow rates and power density yet is limited in the range over which the load may be "throttled" because of the impracticality of a vacuum-throttle system. Because the two-stroke cycle does not provide positive-displacement purging of exhaust gases and positive-displacement suction and induction of an intake charge, a conventional vacuum-throttle system cannot be effectively employed without adding external pumping devices. Although a positive-displacement ancillary pump may be added to a two-stroke vane engine for scavenging and vacuum-throttle, such a system imposes additional penalties of complexity, friction, thermal constraints, weight, size, performance limitations, and/or cost.

Whereas the pumping hardware and mechanism for the primary engine cycle (compression, combustion, and expansion) is designed to contain pressures on the order of 2000 psi, the scavenging mechanism need only handle pressures on the order of 20 psi. In addition to this two order of magnitude reduction in pressures, the scavenging mechanism need not address the many complex constraints imposed on the internal combustion pumping mechanism, such as crevice volumes, dramatic heat flux rates and associated expansion issues, surface area-to-volume ratios, critical sealing performance, and many other factors. For these reasons, it would be inefficient to employ the primary pumping mechanism for the purpose of scavenging the gases and providing a vacuum throttle. This inefficiency would manifest itself in a dramatic reduction in power density and a dramatic increase in cost, by moving to a four-stroke design to achieve scavenging and vacuum throttle. In short, the primary pumping mechanism of an internal combustion engine is an overly bulky and slow means to employ for the task of positive-displacement scavenging.

Therefore, there exists a need for a simple high-speed rotary mechanism, which, when mated to and meshed with a vane pumping machine, will provide rapid positive-displacement scavenging and vacuum throttle capability to the vane cells without imposing a significant penalty in power density, cost, or complexity.

SUMMARY OF THE INVENTION

Accordingly, the present invention is directed to a rotary vane pumping machine that substantially overcomes one or more of the problems due to the limitations and disadvantages of the related art.

It is an object of the present invention to provide a rotary scavenging device that meshes will the vane cells in such a way as to provide high-speed, positive-displacement scavenging (purging and induction) to the vane cells at the targeted location.

It is another object of the present invention to provide non-contact meshing of the rotary scavenging device with the vanes and rotor so that the lubrication-less design of the primary vane device may be maintained.

It is yet another object of the present invention to provide positive-displacement suction to the induction process within a two-stroke cycle so that a traditional vacuum-throttle may be employed.

In the present invention, an engine geometry is employed utilizing reciprocating vanes which extend and retract synchronously with the relative rotation of the rotor and the shape of the chamber surface in such a way as to create cascading cells of compression and/or expansion, thereby providing the essential components of a pumping machine.

More specifically, the present invention is directed to rotary vane pumping machine that includes a stator and rotor in relative rotation. The rotor has a plurality of radial vanes slots and each one of a corresponding plurality of vanes slides within a radial vane slot of the rotor. Each pair of adjacent vanes defines a vane cell. A rotary scavenging disk is disposed along the stator circumference, and is sized such that the rotary scavenging disk extends into the vane cell. An outer circumferential edge of the rotary scavenging disk is in sealing proximity with an outer circumferential edge of the rotor.

Such a rotary scavenging mechanism provides the benefits of positive-displacement scavenging and vacuum throttle capability to a two-stroke vane engine. By employing such a rotary scavenging mechanism the two-stroke vane engine reaps the benefits derived from a four-stroke design without incurring any of the associated penalties and tradeoffs. In addition, such a rotary scavenging mechanism provides additional or alternative benefits to certain applications, centering around the derived capability to access the vane cells at targeted positions during the pumping cycle, to purge the cell, exchange gases from/to the cell, and/or induct gases into the cell.

To achieve these and other advantages and in accordance with the purpose of the invention, there is provided a rotary vane pumping machine comprising a stator assembly and a rotor, with the rotor having a plurality of radial vane slots and the rotor and stator being in relative rotation. Each of a plurality of vanes extends and retracts within a corresponding one of the radial vane slots of the rotor, wherein a pair of adjacent vanes defines a vane cell. A rotary scavenging disk is disposed along a portion of the stator and extends into the vane cell, wherein an outer circumferential edge of the rotary scavenging disk is in sealing proximity with an outer circumferential edge of the rotor. The rotary scavenging disk contains at least one recess formed along the outer circumferential edge thereof. The rotation of the rotor and the rotary scavenging disk is synchronized by a gearing system.

The tip of each vane selectively contacts and slides along an inner wall of the at least one recess as the vane extends and retracts within the corresponding one of the radial vane slots of the rotor. Also, an azimuthal face of each vane selectively contacts one of the rotary scavenging disk seal projections of the rotary scavenging disk as the vane extends and retracts within the corresponding one of the radial vane slots of the rotor.

In another embodiment, a plurality of recesses may be formed along the outer circumferential edge of the rotary scavenging disk, and each recess is alternatively brought into contact with the vane as the vane extends and retracts within the corresponding one of the radial vane slots of the rotor.

BRIEF DESCRIPTION OF THE DRAWINGS

The foregoing and other objects, aspects, and advantages will be described with reference to the drawings, certain dimensions of which have been exaggerated and distorted to better illustrate the features of the invention, and wherein like reference numerals designate like and corresponding parts of the various drawings, and in which:

FIGS. 4A through 4M are sequential views of the rotary-vane pumping machine in FIG. 1 as the machine progresses through a scavenging cycle, illustrating the respective positions of the rotary scavenging disk with reference to the rotor, vane and vane cells;

DETAILED DESCRIPTION OF THE INVENTION

Reference will now be made in detail to an embodiment of a rotary pumping machine incorporating a rotary scavenging device, examples of which are illustrated in the accompanying drawings. The embodiments described below may be incorporated in all rotary-vane or sliding vane pumping machines.

As used herein, the term "roller" bearing or "rolling" bearing means any style of rolling, anti-friction bearing design, including for example, spherical bearings, cylindrical bearings, or any other suitably shaped rolling bearing know to those of ordinary skill in the art.

U.S. patent application Ser. Nos. 08/887,304, to Mallen, filed Jul. 2, 1997, entitled "Rotary-Linear Vane Guidance in a Rotary Vane Pumping Machine" ('304 application); 09/187,705, to Mallen, filed Nov. 4, 1998, entitled "Rotary-Linear Vane Guidance in a Rotary Vane Pumping Machine" ('705 application); and 09/258,791, to Mallen, filed Mar. 1, 1999, entitled "Vane Pumping Machine Utilizing Invar-Class Alloys for Maximizing Operating Performance and Reducing Pollution Emissions" ('791 application), are all hereby incorporated by reference in there entirety. The '304, '705 and '791 applications describe a rotary-linear vane guidance mechanism. For ease of discussion, certain portions of the '304, '705 and '791 applications will be reiterated below where appropriate.

Figure 1:
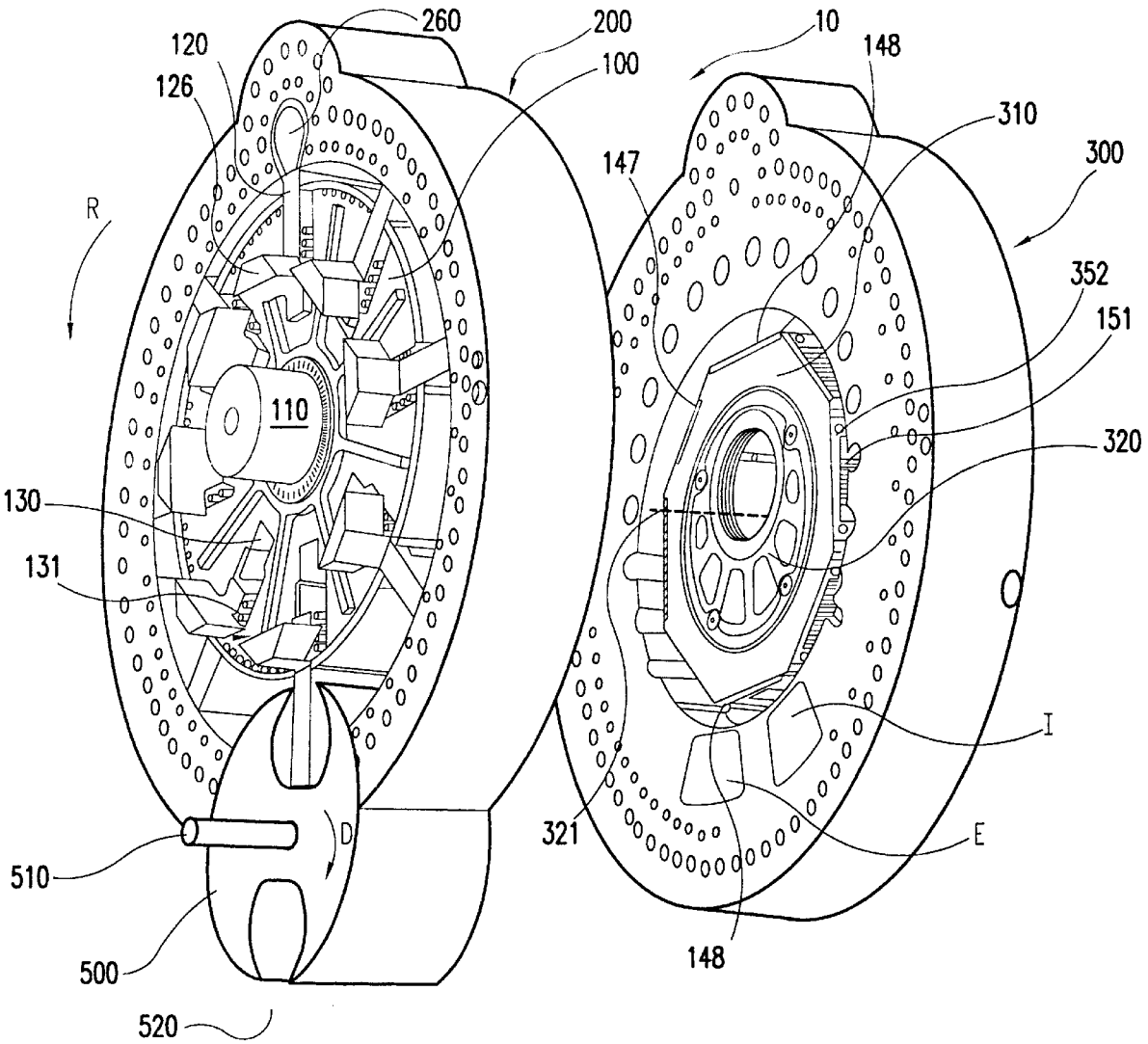
FIG. 1 is a perspective view of a rotary scavenging disk for a rotary-vane pumping machine in accordance with the present invention.
Figure 2:
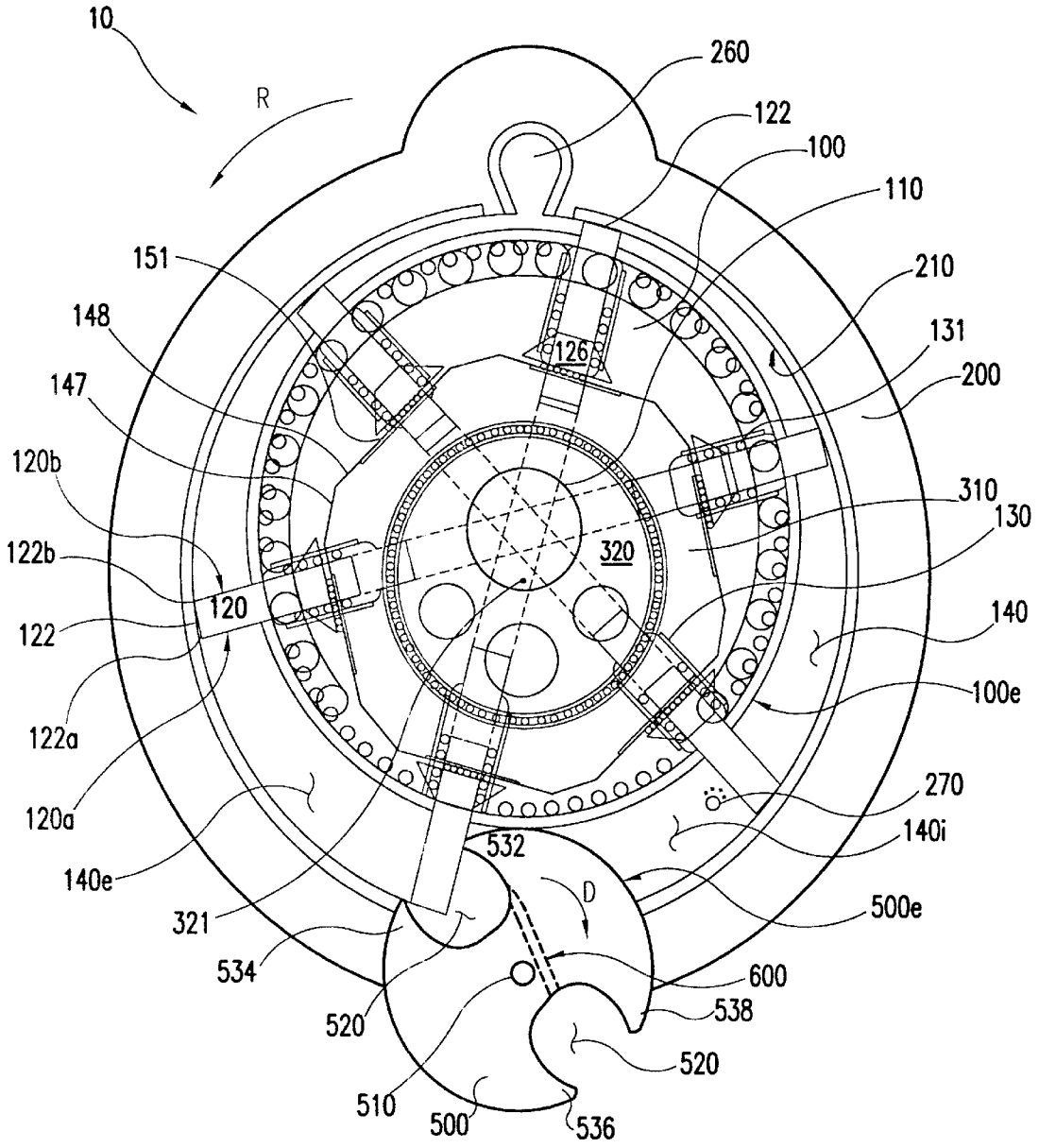
FIG. 2 is a side view of the rotary scavenging disk for a rotary-vane pumping machine in accordance with the present invention with an end plate removed.

An exemplary embodiment of the rotary engine assembly incorporating a rotary-linear vane guidance mechanism and a rotary scavenging device is shown in FIG. 1 and FIG. 2 and is designated generally as reference numeral 10.

The engine assembly contains a rotor 100, with the rotor 100 and rotor shaft 110 rotating about a rotor shaft axis in a counter clockwise direction as shown by arrow R in FIG. 1. It can be appreciated that when implemented, the engine assembly could be adapted to allow the rotor 100 to rotate in a clockwise direction if desired. The rotor 100 has a rotational axis, at the axis of the rotor shaft 110, that is fixed relative to a stator cavity 210 contained in the chamber ring assembly 200.

The rotor 100 houses a plurality of vanes 120 in vane slots 130, wherein each pair of adjacent vanes 120 defines a vane cell 140. The contoured stator 210 forms the roughly circular shape of the chamber outer surface.

Each of the vanes 120 has a tip portion 122 and a base portion, with a protruding tab 126 extending from either or both axial ends near the base portion as shown in FIG. 1. While the protruding tab 126 of the vane in FIG. 1 is trapezoidal, the invention is not limited to such a design, it being understood that the tab may take on many shapes within the scope of the invention. The tab need not be symmetrical with respect to the vane nor with the opposing tab, if any. As shown in FIG. 2, the vane 120 has two azimuthal faces 120*a* and 120*b* which lead or trail the azimuthal direction of rotation of the vane when the vane is installed in the rotor 100 and the pumping machine 10 is operated. A plurality of roller bearings 131 are provided between the vane 120 and the vane slot 130 such that the azimuthal faces 120*a* and 120*b* have a rolling interface with the slots 130 of the rotor 100.

In a rotary vane engine, momentum is transferred from the expanding gases working on the vanes 120 in the expanding vane cell 140, to the rotor 100 through the load bearing function of the rollers in the assembly 131. In a rotary pump and during the exhaust or pre-combustion compression cycles, momentum is transferred from the rotor to the gases in a compressing vane cell 140 through the load bearing function of the rollers in the assembly 131. In both embodiments, the vanes 120 are radially reciprocating relative to the rotor slots 130, and the friction of sliding between the radially reciprocating vanes and the rotor is reduced by the rolling function of the rollers in the assembly 131. The present invention may utilize the novel vane slot roller assembly disclosed in U.S. patent application Ser. No. 09/185,707, to Mallen, filed Nov. 4, 1998, entitled "Vane Slot Roller Assembly for Rotary Vane Pumping Machine, and Method for Installing Same" ('707 application), which is hereby incorporated by reference in its entirety.

As shown in FIG. 1, an end plate 300 is disposed at each axial end of the chamber ring assembly 200. Within the end plate 300, a linear translation ring 310 spins freely around a fixed hub 320 located in the end plate 300, with the axis 321 of the fixed hub 320 being eccentric to the axis of rotor shaft 110 as best seen in FIG. 2. The linear translation ring 310 may spin around its hub 320 utilizing any type of bearing at the hub-ring interface including for example, a journal bearing of any suitable type and an anti-friction rolling bearing of any suitable type.

The linear translation ring 310 comprises a outer radial surface 147 having a plurality of connected linear segments 148 or facets. The protruding tabs 126 of the vanes 120 slide along a corresponding linear segment 148 of the outer radial surface 147, which provides sufficient linear and radial guidance to the vanes 120. A plurality of roller bearings 151 are provided between the lower surface of the vane tab 126 and the linear segment 148, such that the vane tab 126 has a rolling interface with the translation ring 310.

In operation, the rotor 100 rotation causes rotation of the vanes 120 and a corresponding rotation of each linear translation ring 310. The protruding vane tabs 126 translating along the linear segments 148 of the linear translation rings 310 automatically set the linear translation rings 310 in rotation at a fixed angular velocity identical to the angular velocity of the rotor 100. Therefore, the linear translation ring 310 does not undergo any significant angular acceleration at a given rotor rpm.

Also, the rotation of the rotor 100 in conjunction with the linear translation rings 310 automatically sets the radial position of the vanes 120 at any rotor angle, producing a single contoured path as traced by the vane tips 122 resulting in a unique stator cavity 210 shape that mimics and seals the path the vane tips trace.

No gearing is needed to maintain the proper angular position of the linear translation rings 310 because this function is automatically performed by the geometrical combination of the tabs 126 within the linear segments 148 of the linear translation rings 310, the vanes 120 constrained to radial motion within their rotor slots 130, the rotor 100 about its shaft 110 axis, and the translation ring hub 320 about its offset axis 321 at the center of the fixed hub 320.

When the present invention is utilized with internal combustion engines, one or more fuel injection/induction devices 270 (FIG. 2) may be used and may be placed on one or both axial ends of the chamber and/or on the outer or inner circumference of the chamber. Exemplary fuel injection/induction/mixing devices are shown and described in U.S. Pat. Nos. 5,524,587; 5,524,587; and 5,836,282, which are all hereby incorporated by reference in their entirety. Each injector 270 may be placed at any position and angle chosen to facilitate equal distribution within the cell or vortices while preventing fuel from escaping into the exhaust stream. The injector(s)/inductor(s) 270 may alternatively be placed in the intake port air flow as more fully described in U.S. Pat. No. 5,524,586.

In addition, if utilized with internal combustion engines, a flame pocket (i.e., a combustion residence chamber) 260 may be provided in the chamber ring assembly 200. The flame pocket 260 is a cavity or series of cavities within the chamber ring assembly 200, radially and/or axially disposed from a vane cell 140, which communicates with the air or fuel-air charge at about peak compression in the engine assembly. The flame pocket 260 may physically create an extended region in communication the vane cell 140 during peak compression.

A pair of cooling plates (not shown) may be provided, one each axially adjacent to a respective end plate 300, to encase the engine 10, to provide for cooling channels, and to serve as an attachment point for various devices used to operate the engine 10. Of course, the function of the cooling plates may be incorporated in the end plates 300. In other words, a single plate could provide the features of both the end plate 300 and the cooling plate, or separate plates could be utilized.

The cooling system for such a rotary vane pumping machine was described in U.S. patent application Ser. No. 09/185,706, to Mallen, filed Nov. 4, 1998, entitled "Cooling System for a Rotary Vane Pumping Machine" (the '706 application), which is hereby incorporated by reference in its entirety. Basically, the '706 application describes a cooling system that can cool either the rotor 100 and associated moving parts, or the stator assembly 200, or both, depending on the operation of the rotary vane pumping machine.

The illustrated embodiment employs a two vane-stroke cycle to maximize the power-to-weight and power-to-size ratios of the machine. In other words, each vane retracts (first stroke) and extends (second stroke) once for each complete combustion or pumping cycle. By comparison, in a four vane-stroke cycle, each vane would retract and extend twice for each complete combustion or pumping cycle. The intake of the fresh air I and the scavenging of the exhaust E are provided via the scavenging device 500 as shown in FIG. 1 and FIG. 2.

Figure 4A:
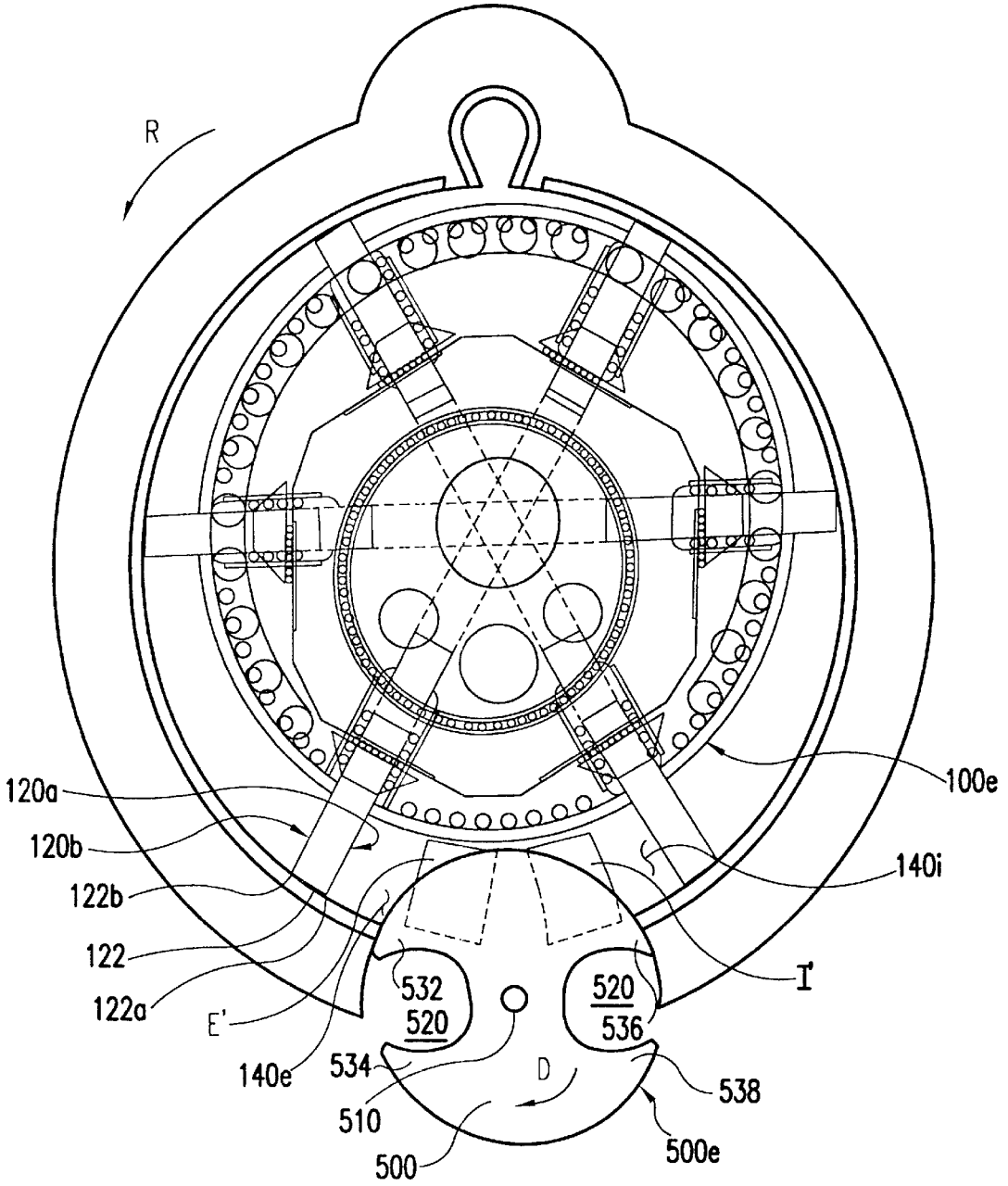

The scavenging mechanism of the present invention will now be described in greater detail. As shown in FIG. 1, an intake duct I and an exhaust duct E are provided in the end plates 300, with the inner axial extent of the ducts communicating with the vane cells 140 within the chamber ring assembly 200. Alternatively, one or both of the intake and exhaust ducts may be provided in the chamber ring assembly 200 itself. The inner axial extent (i.e., intake port) I' of the intake duct I and the inner axial extent (i.e., exhaust port) $E^1$ of the exhaust duct E are best shown in FIG. 4A. The intake port I' and the exhaust port E' may be located in different positions, depending on the configuration and operation of the machine. More specifically, for the two vane-stroke embodiment shown in FIG. 2, the intake port I' and the exhaust port E' are disposed in the bottom central portion of the machine 10, given the rotation of the rotor R as depicted, and the ports are brought into selective communication with the vane cells 140. Such selective communication is accomplished via a rotary scavenging disk 500.

Figure 3:
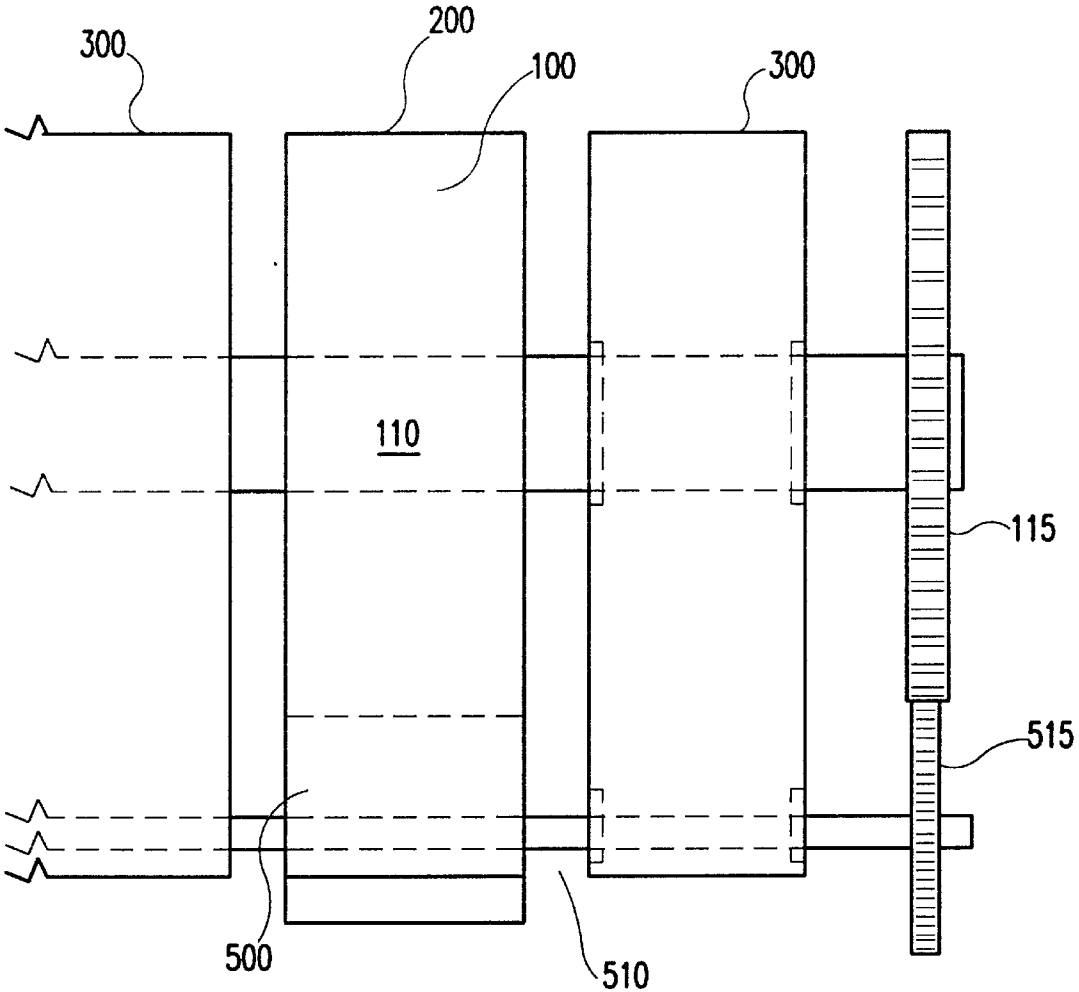
FIG. 3 is a simplified exploded schematic end view of the gearing relationship between the rotor shaft and the rotary scavenging disk shaft for the rotary-vane pumping machine in FIG. 1.

As shown in FIG. 2, the rotary scavenging disk 500 rotates around disk shaft 510, the axis of which is spaced from the rotor shaft axis at a location that is preferably between the inner and outer circumferences of the chamber ring assembly 200. The rotary scavenging disk 500 extends into the vane cell 140, such that the outer circumferential edge 500*e* of the rotary scavenging disk 500 is in sealing proximity with an outer circumferential edge 100*e* of the rotor 100. When in sealing proximity, the outer circumferential edge 500*e* of the rotary scavenging disk 500 separates the intake flow from the exhaust flow. The sealing proximity is accomplished via any suitable mechanism, such as a geared relationship between the rotor shaft 110 and rotary scavenging disk shaft 510 as shown in FIG. 3. The rotary scavenging disk gear 515 rotates around disk shaft 510, and mates with the rotor gear 115 which rotates around rotor shaft 110. In the configuration shown in FIG. 3, the rotary scavenging disk 500 rotates about three times faster than the rotor. Note that the tangential velocity of the outer surface of the rotary scavenging disk need not match or even approximate the tangential velocity of the outer surface of the rotor. Of course, depending on the number of vanes, and the sizes of the rotor and rotary scavenging disk, different speed relationships and geometries can be employed. Also, the outer diameter of the rotary scavenging disk need not be round, but may have protrusions and recesses to match and seal against the shape of the rotor surface.

To accommodate each of the approaching vanes 120 as they continue to extend relative to the vane slots 130, at least one or more recesses 520 are provided in the rotary scavenging disk 500. The recesses 520 are shaped so as to cooperate with the azimuthal faces 120*a*, 120*b* and/or the tips 122 of the vane 120 so as to maintain a suitable sealing separation between the intake and exhaust portions, even when the outer circumferential edge 500*e* of the rotary scavenging disk 500 is momentarily not in sealing proximity with the outer circumferential edge 100*e* of the rotor 100.

An important design goal with any scavenging approach is to minimize the fraction of hot recirculated exhaust gases, thereby maximizing scavenging efficiency. Ideally, all exhaust gases would be purged from the vane cell 140 before inducting fresh intake charge. Exhaust gas recirculation may offer pollution and other benefits, but it is best cooled before induction to preserve thermal efficiency. The rotary scavenging disk recess size, profiles and rotational speed may be optimized to minimize the exhaust recirculation. In addition, as described later, the recesses 520 not in communication with the vane cell 140 may be open to or cleared with fresh air to minimize the intrusion of exhaust gases into the recess during the exhaust phase of the scavenge process.

The continuous sealing proximity and the maintenance of the separation between the intake and exhaust area of the machine will now be described in greater detail with reference to the sequential side views of the machine 10 as shown in FIGS. 4A to 4M.

Each of the views is spaced at a 5° interval, showing a full scavenge cycle of a vane cell 140. The rotor 100 is rotating in a counter clockwise direction R while the rotary scavenging disk 500 is rotating in a clockwise direction D. As used herein, the term "approaching vane" refers to a vane that has not yet reached the bottom dead center portion of the engine cycle, where the rotary scavenging disk 500 is located, as determined by the direction of rotor rotation. The term "departing vane" refers to the same vane that has passed the bottom dead center portion of the engine cycle, where the rotary scavenging disk 500 is located, as determined by the direction of rotor rotation. Also, with regard to the vane tip portions, the terms "leading tip" and "trailing tip" are determined with reference to the direction of rotor rotation.

FIG. 4A illustrates the vane and rotary scavenging disk orientation when the approaching vane is 30° from bottom dead center (bdc). The outer circumferential edge 500*e* of the rotary scavenging disk 500 is in sealing proximity with the outer circumferential edge 100*e* of the rotor 100, and the recesses 520 are closed off from the vane cell 140. With reference to the rotation R of the rotor 100, note also that the next approaching vane 120 has not yet reached the disk area, while another departing vane 120 has already passed the disk area. In this configuration, the intake duct I' and the exhaust duct E' are separated from each other by the sealing proximity between the outer circumferential edge 500*e* of the rotary scavenging disk 500 and the outer circumferential edge 100*e* of the rotor 100. As the approaching vane 120 gets closer to the disk area, the exhaust gases in the exhaust vane cell 140*e* are being compressed and forced through the exhaust duct E'. At the same time, air is being inducted into the intake vane cell 140*i* via the intake duct I'.

Figure 4B:
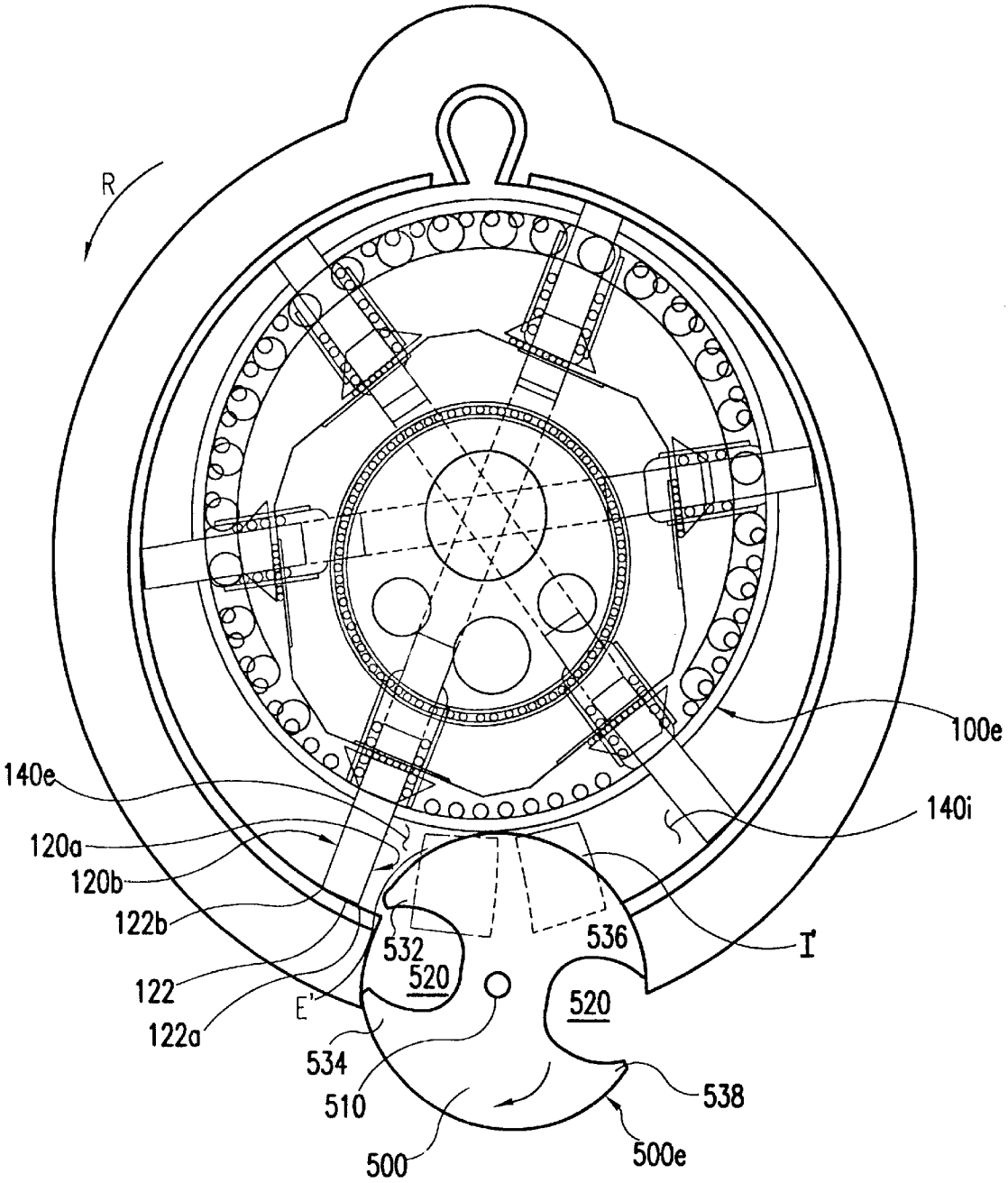

FIG. 4B illustrates the vane and rotary scavenging disk orientation when the approaching vane is 25° from bottom dead center (bdc). Here, a rotary scavenging disk seal projection 532 of the recess 520 is initially exposed to the vane cell 140*e*. The outer circumferential edge 500*e* of the rotary scavenging disk 500 still maintains sealing proximity with the outer circumferential edge 100*e* of the rotor 100 to separate the intake and exhaust regions.

Figure 4C:
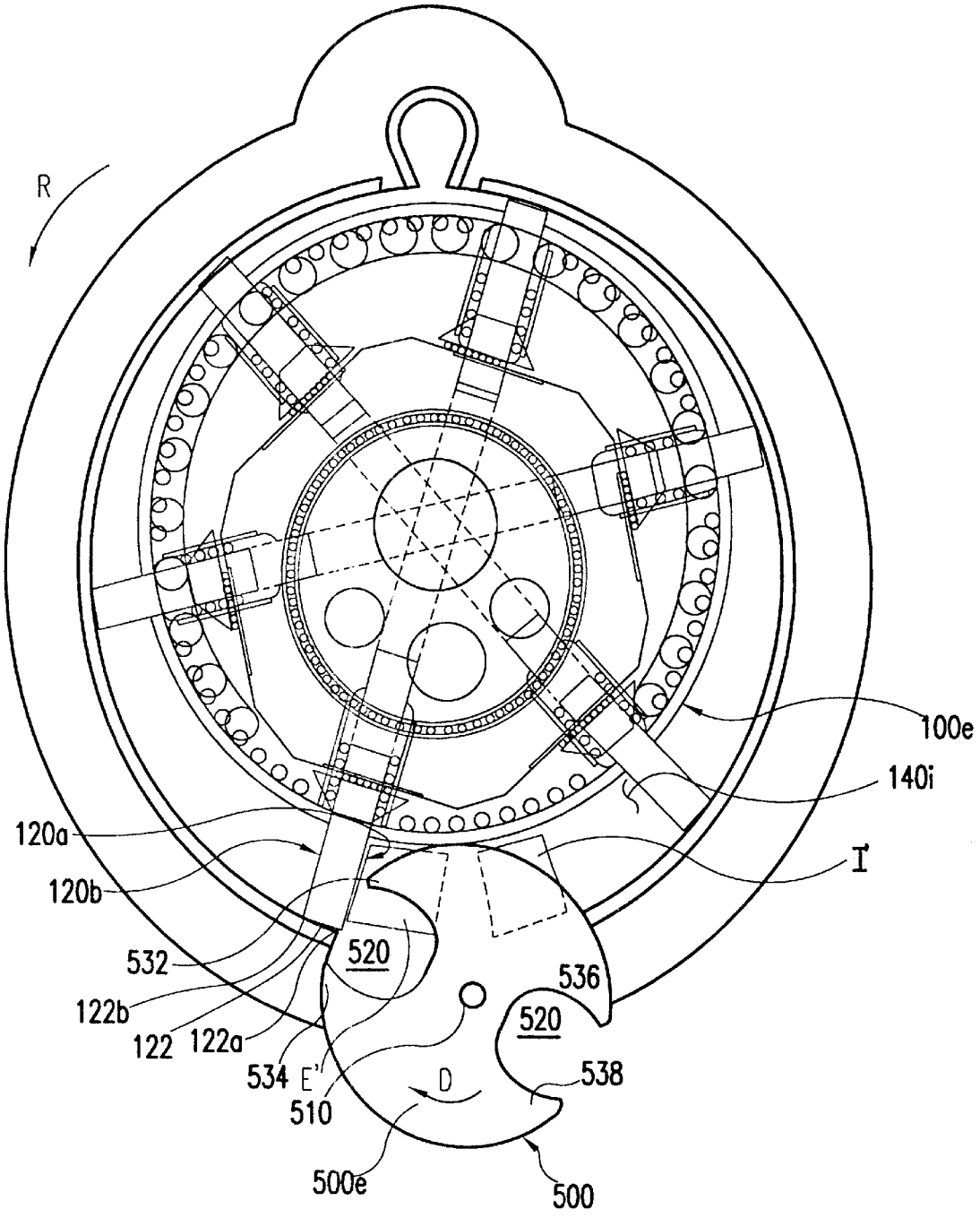

FIG. 4C illustrates the vane and rotary scavenging disk orientation when the approaching vane is 20° from bottom dead center (bdc). The approaching vane 120 nearly contacts the circumferentially spaced seal projections 532, 534 of the rotary scavenging disk 500 which define the recess 520. In this configuration, the intake duct I' and the exhaust duct E' are still separated from each other by the sealing proximity between the outer circumferential edge 500*e* of the rotary scavenging disk 500 and the outer circumferential edge 100*e* of the rotor 100. Again, as the approaching vane 120 continues to get closer to the disk area, the exhaust gases in the exhaust vane cell 140*e* are being compressed and forced through the exhaust duct E'. At the same time, air is still being inducted into the intake vane cell 140*i* via the intake duct I'. While a small amount of exhaust gas in the exhaust vane cell 140*e* may leak around the vane tip 122 and flow into the recess 520 at this point, this would not appreciably affect the performance of the machine.

Figure 4D:
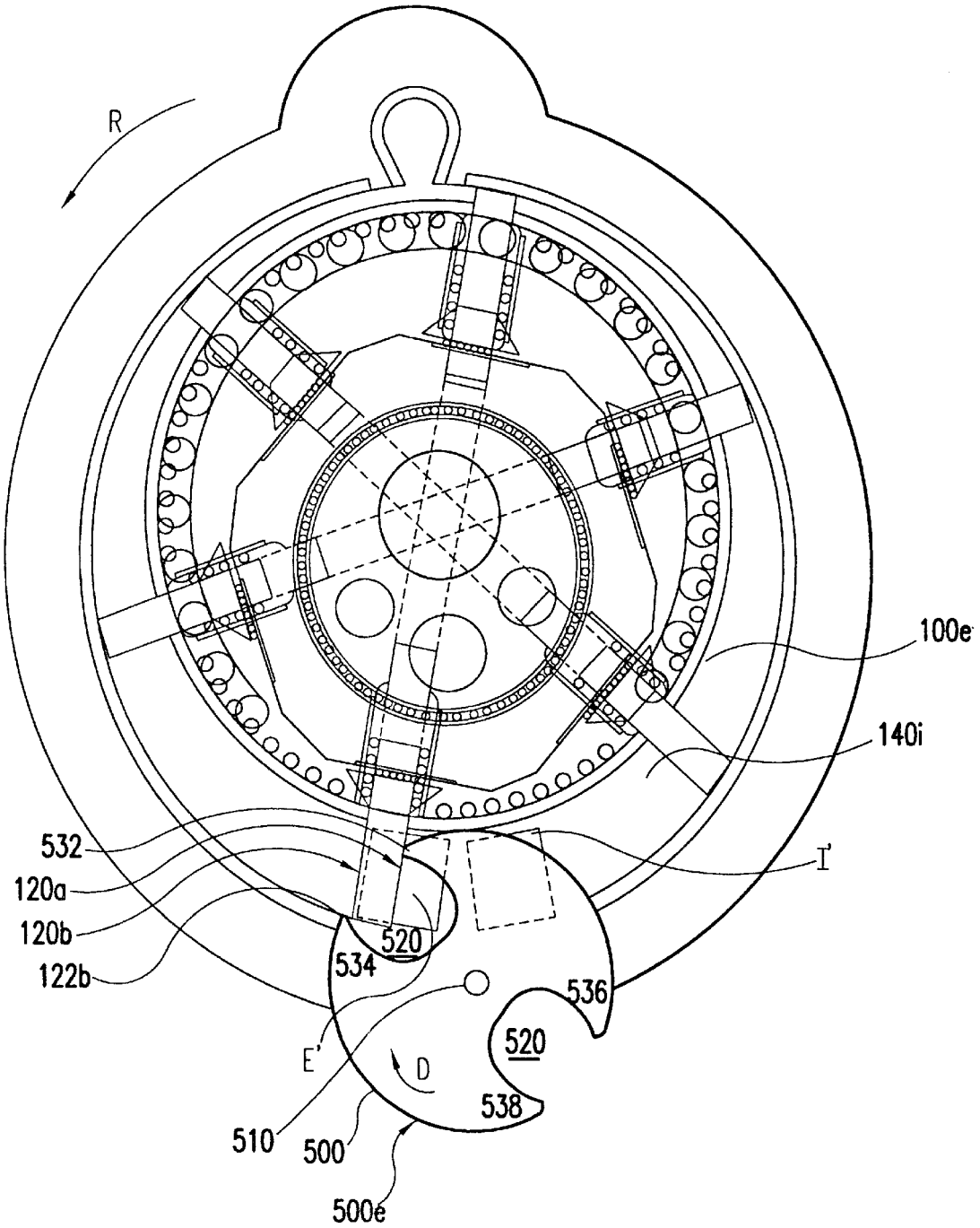

FIG. 4D illustrates the vane and rotary scavenging disk orientation when the approaching vane is 15° from bottom dead center (bdc). The approaching vane 120 now contacts the seal projections 532, 534 of the rotary scavenging disk 500 which define the recess 520. The forward azimuthal face 120*a* of the vane 120 contacts the rotary scavenging disk seal projection 532 while the trailing tip portion 122*b* of the vane contacts the other rotary scavenging disk seal projection 534. In this configuration, the intake duct I' and the exhaust duct E' are still separated from each other by the sealing proximity between the outer circumferential edge 500*e* of the rotary scavenging disk 500 and the outer circumferential edge 100*e* of the rotor 100, and the sealing proximity between the rotary scavenging disk seal projections 532, 534 and the vane 120. The exhaust gases in the exhaust vane cell 140*e* are being compressed and forced through the exhaust duct E', and air is still being inducted into the intake vane cell 140*i* via the intake duct I'.

Figure 4E:
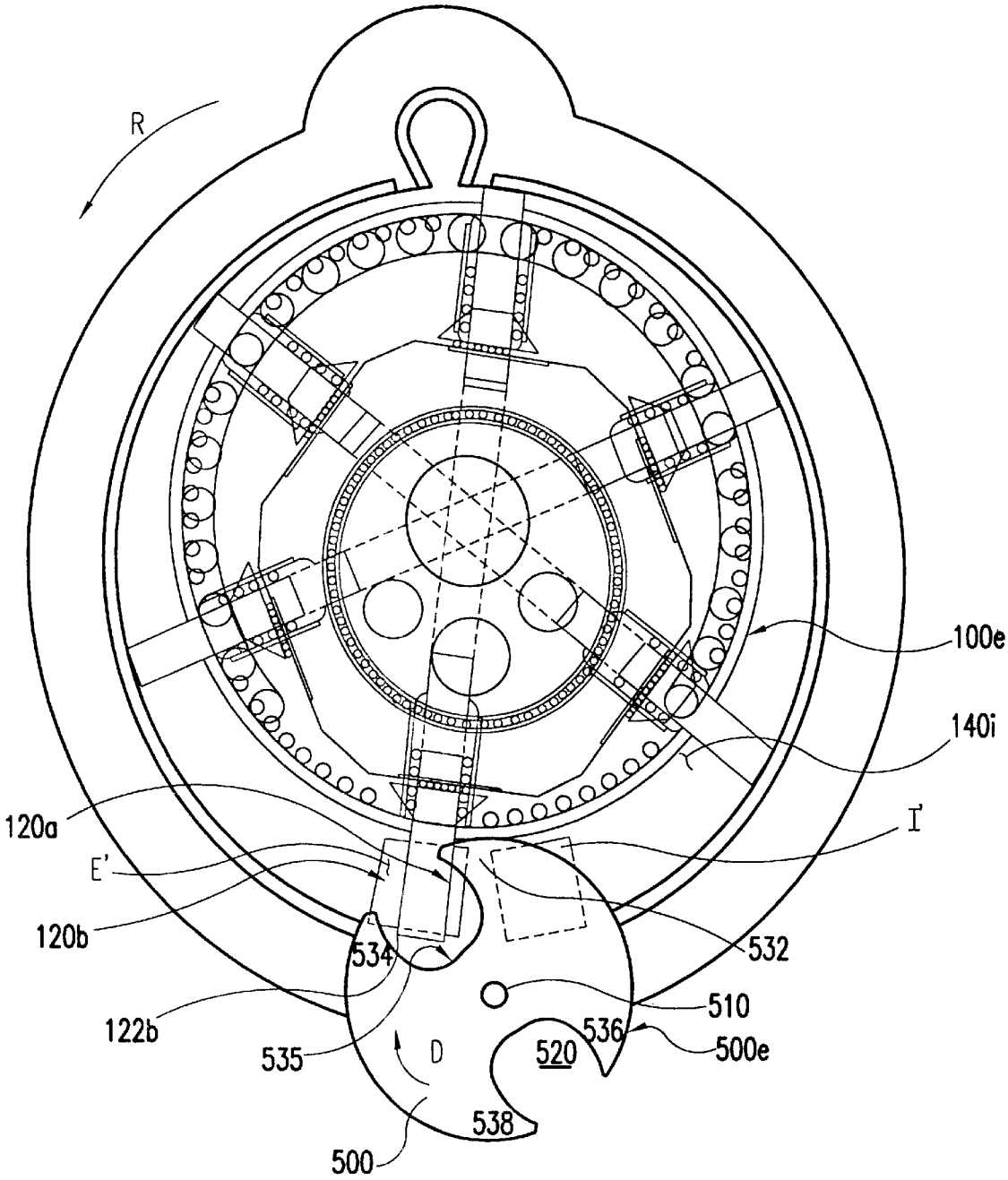

FIG. 4E illustrates the vane and rotary scavenging disk orientation when the approaching vane is 10° from bottom dead center (bdc). Note that the trailing tip portion 122*b* of the vane slides in sealing proximity along the inner wall 535 of the recess 520. The intake duct I' and the exhaust duct E' are still separated from each other by the sealing proximity between the outer circumferential edge 500*e* of the rotary scavenging disk 500 and the outer circumferential edge 100*e* of the rotor 100, together with the sealing proximity between the rotary scavenging disk seal projection 532 and the vane 120, and the trailing tip portion 122*b* and the inner wall 535 of the recess 520.

Figure 4F:
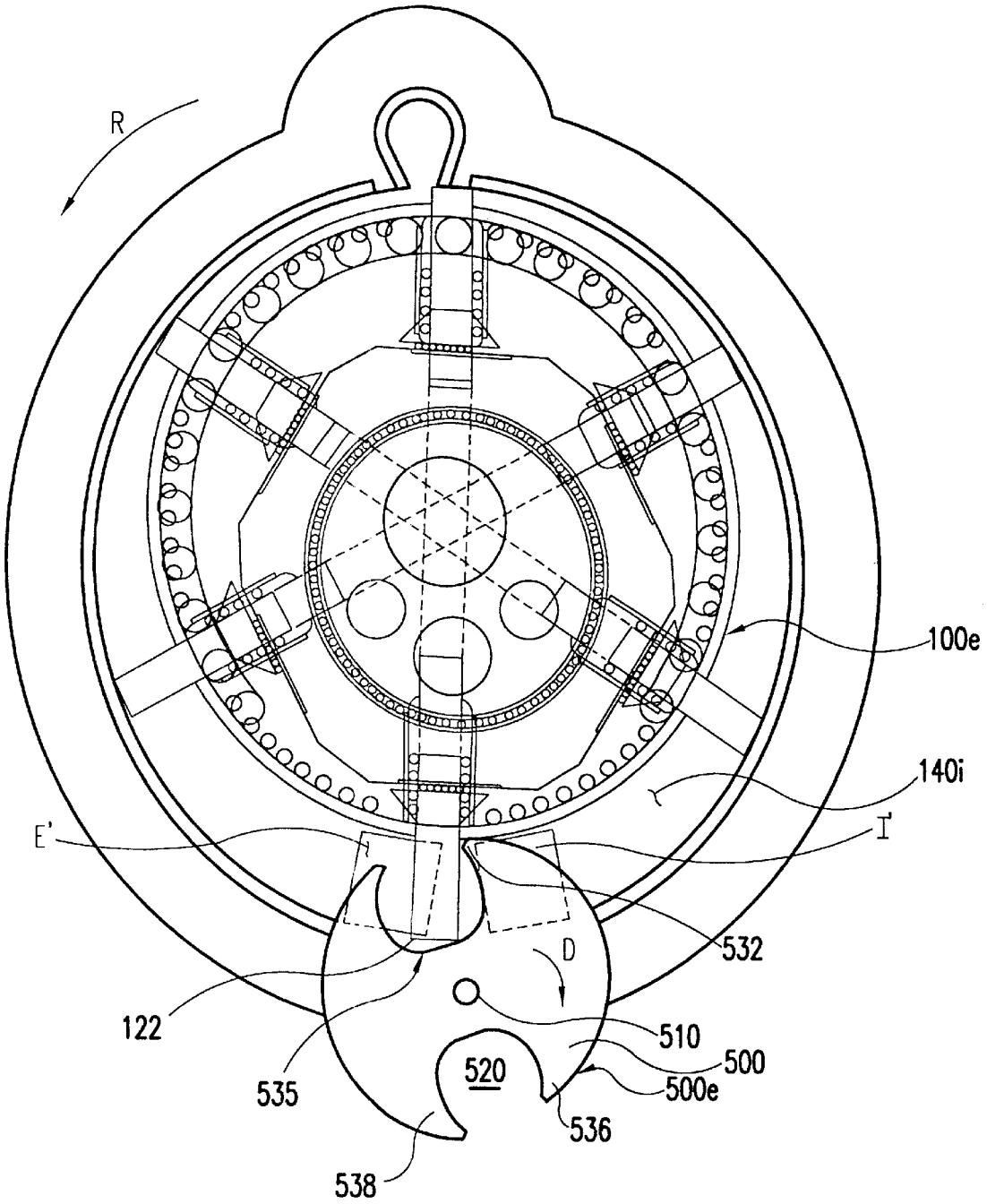

FIG. 4F illustrates the vane and rotary scavenging disk orientation when the approaching vane is 5° from bottom dead center (bdc). The trailing tip portion 122*b* continues to slide in sealing proximity along the inner wall 535 of the recess 520. Although the rotary scavenging disk seal projection 532 has broken contact with the azimuthal face 120*a* of the vane 120, the intake duct I' and the exhaust duct E' are still separated from each other by the sealing proximity between the rotary scavenging disk seal projection 532 and the outer circumferential edge 100*e* of the rotor 100, together with the sealing proximity between the trailing tip portion 122*b* of the vane 120 and the inner wall 535 of the recess 520.

Figure 4G:
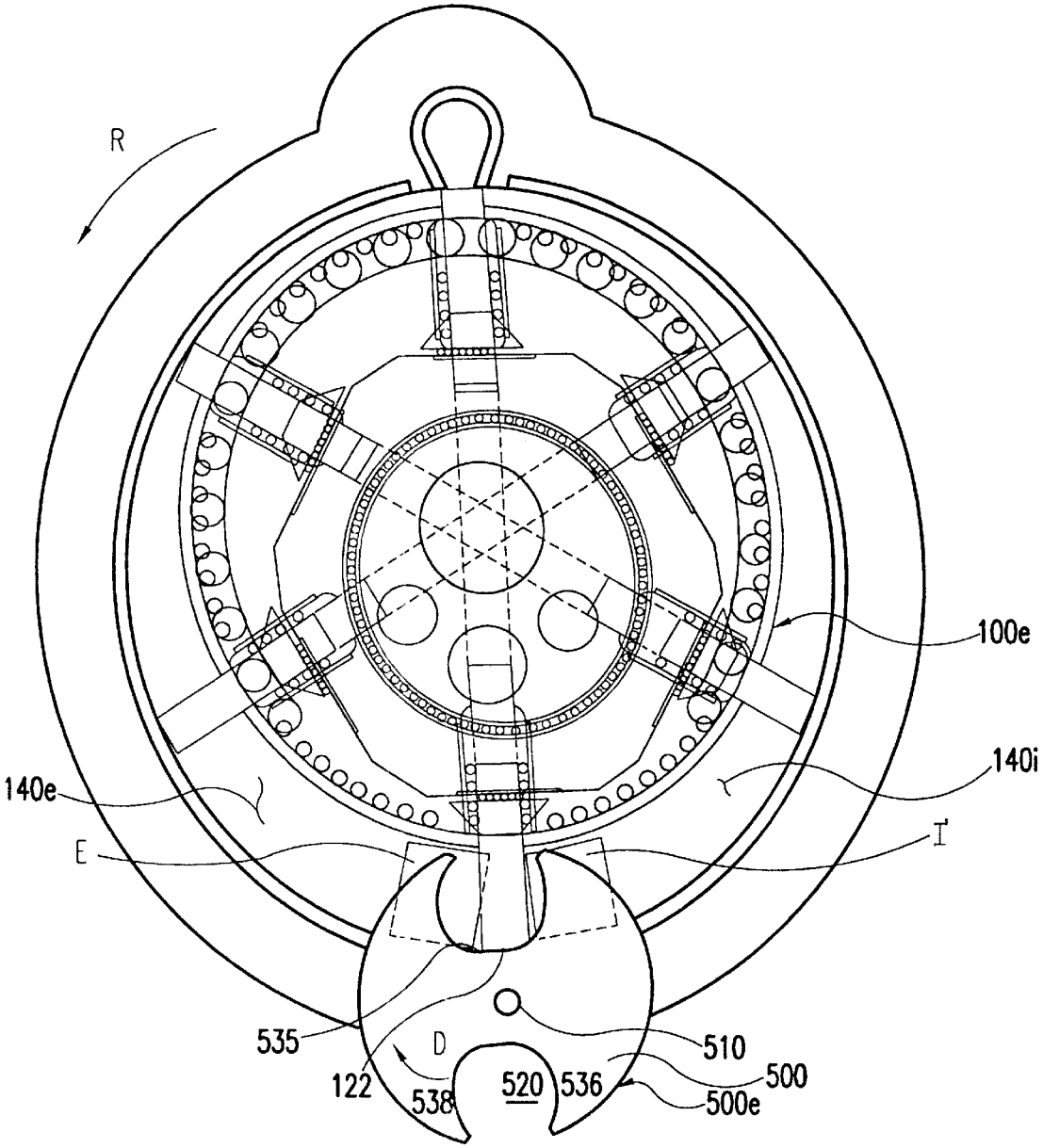

FIG. 4G illustrates the vane and rotary scavenging disk orientation when the approaching vane is at bottom dead center (bdc). In FIG. 4G, the entire tip portion 122 of the vane 120 is in sealing proximity with the inner wall 535 of the recess 520. During this portion of the cycle, the outer circumferential edge 500*e* of the rotary scavenging disk 500 and the outer circumferential edge 100*e* of the rotor 100 are not in sealing proximity, but the continued sealing proximity between the vane tip 122 and the inner wall 535 of the recess 520 provides the requisite flow separation between the intake duct I' and the exhaust duct E'. At this point, nearly all the exhaust gas in the exhaust vane cell 140*e* has been forced through the exhaust duct E', while air is still being inducted into the intake vane cell 140*i* via the intake duct I'.

Figure 4H:
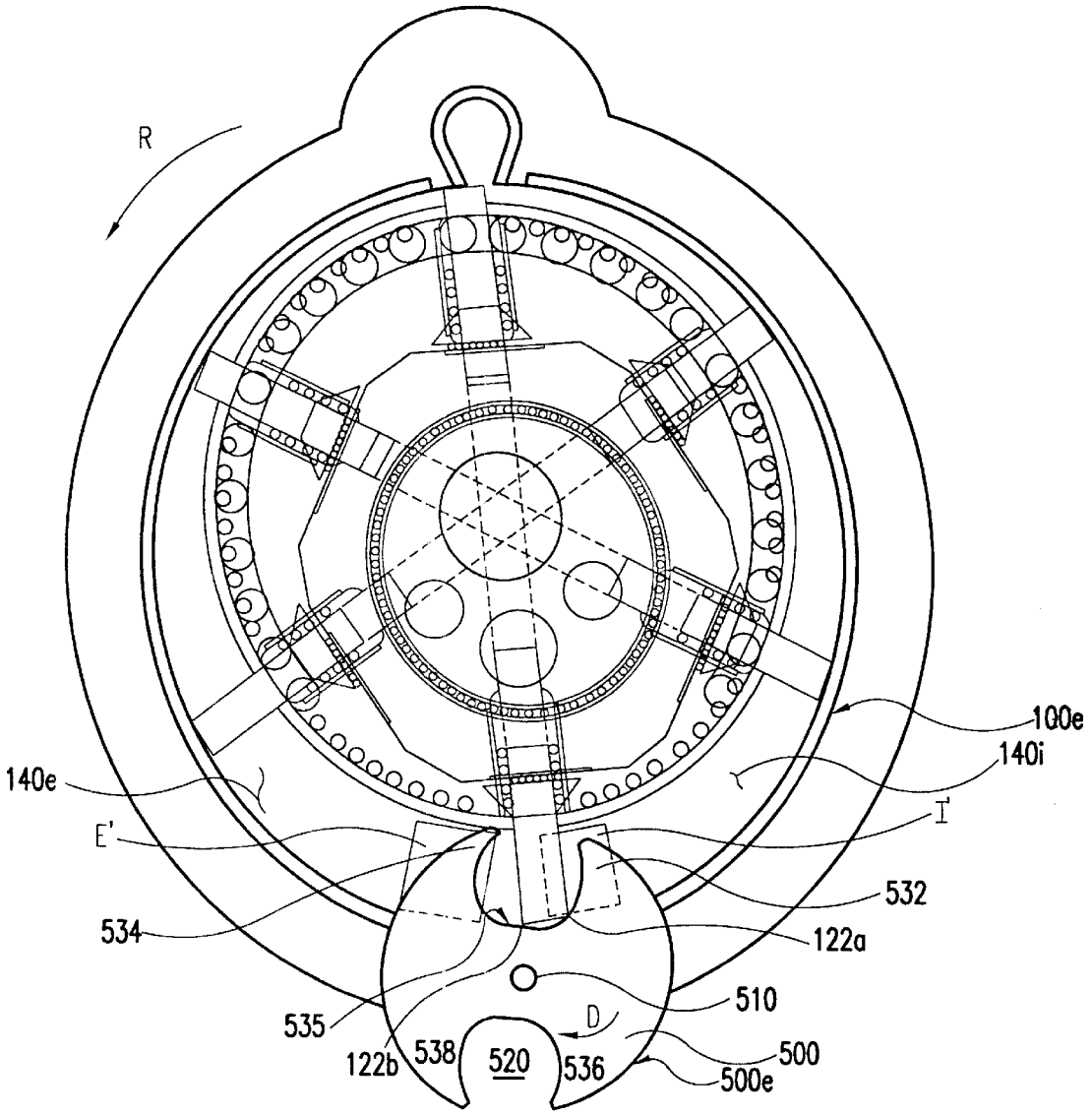

FIG. 4H illustrates the vane and rotary scavenging disk orientation when the vane, now a departing vane, is 5° past bottom dead center (bdc). The trailing tip portion 122*b* of the vane 120 has broken contact with the inner wall 535 of the recess 520. Now the leading tip portion 122*a* of the vane 120 slides in sealing proximity along the inner wall 535 of the recess 520. The intake duct I' and the exhaust duct E' are still separated from each other by the sealing proximity between the rotary scavenging disk seal projection 534 and the outer circumferential edge 100*e* of the rotor 100, together with the sealing proximity between the leading tip portion 122*a* of the vane 120 and the inner wall 535 of the recess 520.

Figure 41:
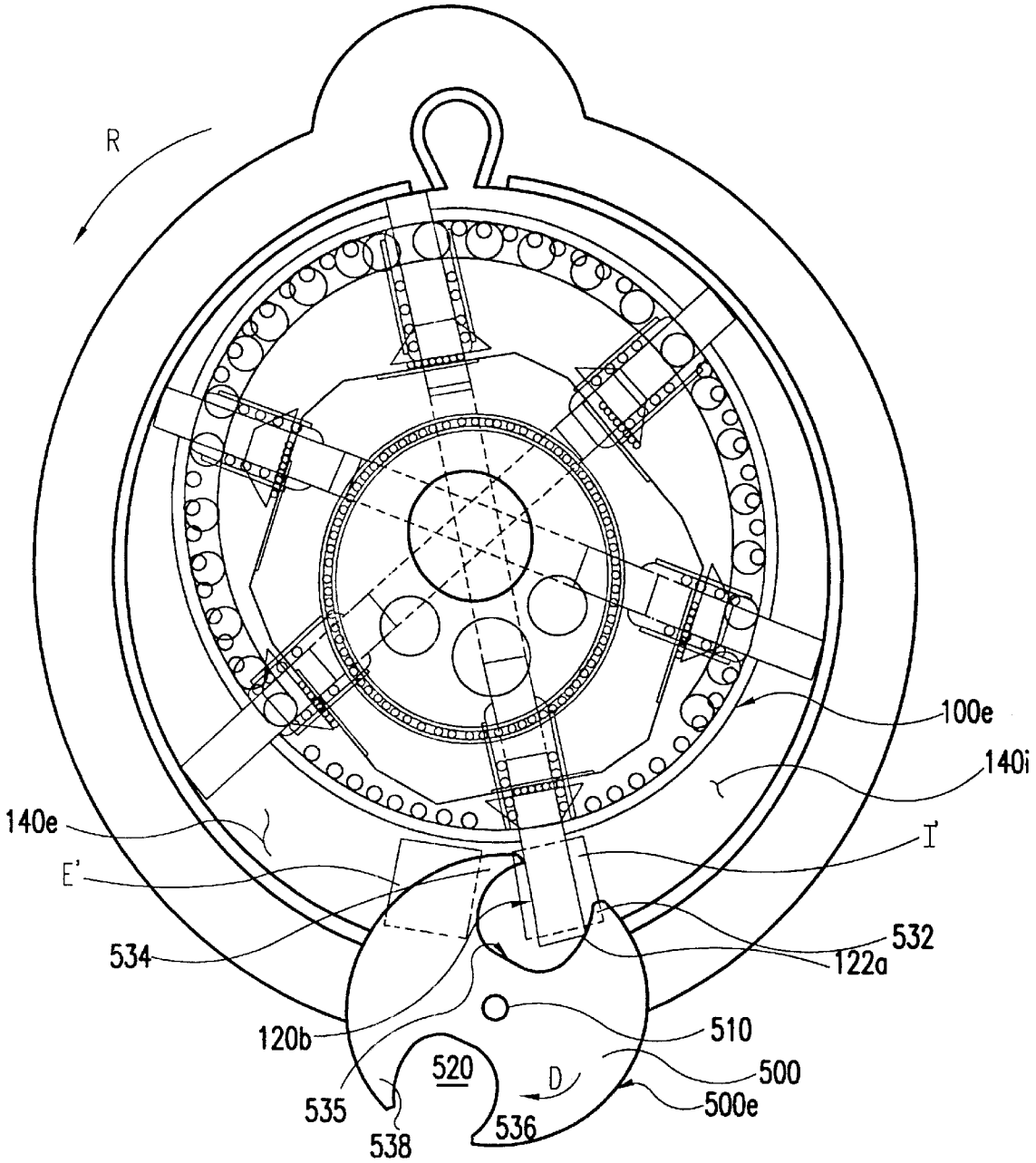

FIG. 41 illustrates the vane and rotary scavenging disk orientation when the departing vane is 10° past bottom dead center (bdc). The leading tip portion 122*a* of the vane 120 still slides in sealing proximity along the inner wall 535 of the recess 520. The intake duct I' and the exhaust duct E' are still separated from each other by the sealing proximity between the outer circumferential edge 500*e* of the rotary scavenging disk 500 and the outer circumferential edge 100*e* of the rotor 100, together with the sealing proximity between the rotary scavenging disk seal projection 534 and the rear azimuthal face 120*b* of vane 120, and the leading tip portion 122*a* and the inner wall 535 of the recess 520.

Figure 4J:
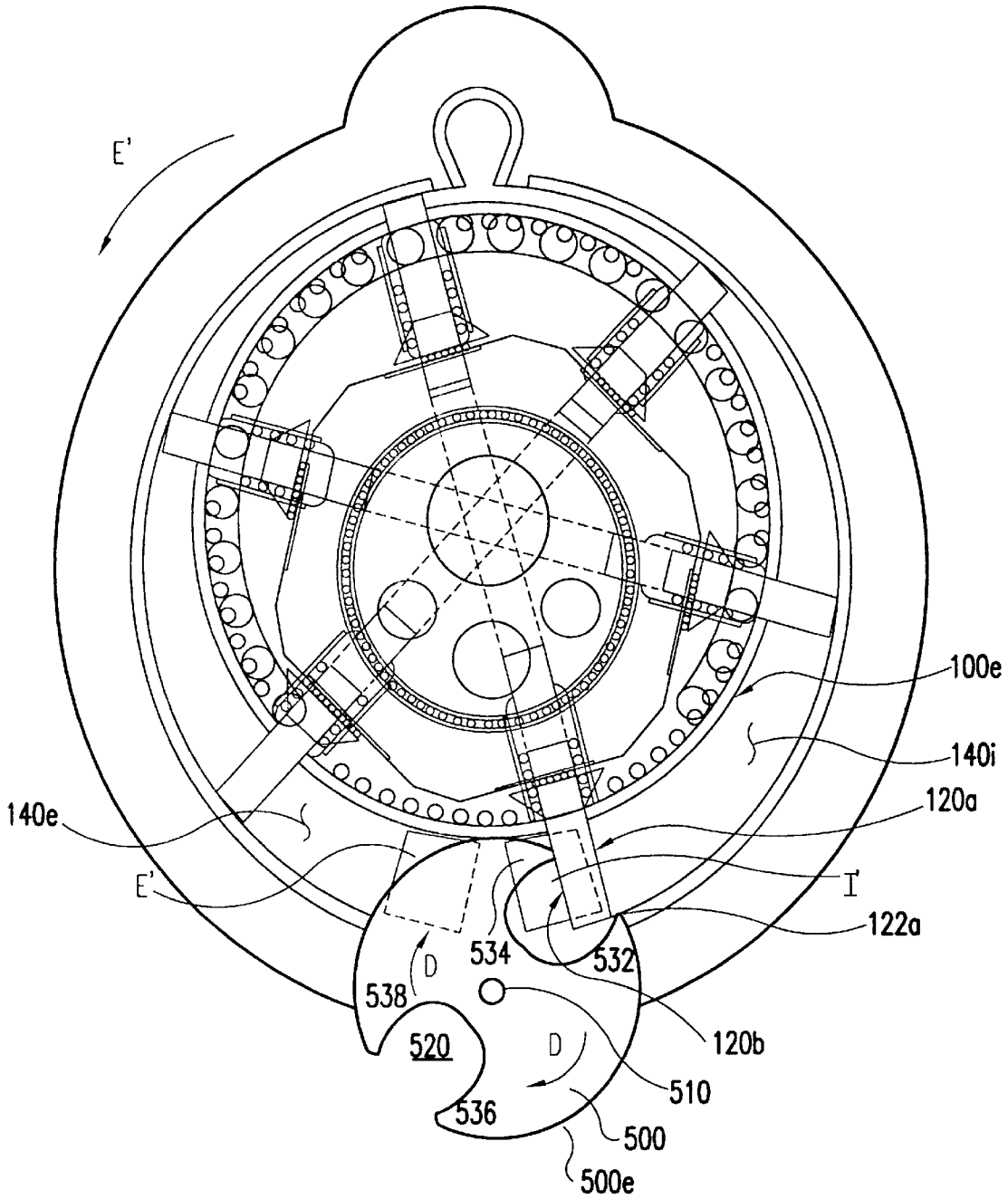

FIG. 4J illustrates the vane and rotary scavenging disk orientation when the departing vane is 15° past bottom dead center (bdc). The departing vane 120 now contacts the seal projections 532, 534 of the rotary scavenging disk 500 which define the recess 520. The leading tip portion 122*a* of the vane 120 contacts the rotary scavenging disk seal projection 532 while the rotary scavenging disk seal projection 534 contacts the rear azimuthal face 120*b* of the vane 120. In this configuration, the intake duct I' and the exhaust duct F' are still separated from each other by the sealing proximity between the outer circumferential edge 500*e* of the rotary scavenging disk 500 and the outer circumferential edge 100*e* of the rotor 100, and the sealing proximity between the rotary scavenging disk seal projections 532, 534 and the vane 120.

As the rotary scavenging disk and rotor continue to rotate in their respective directions, the volume of exhaust gas in the next exhaust vane cell 140*e* starts to be compressed for eventual discharge. The exhaust gases in the exhaust vane cell 140*e* are being compressed and forced through the exhaust duct E', and air is still being inducted into the intake vane cell 140*i* via the intake duct I'.

Figure 4K:
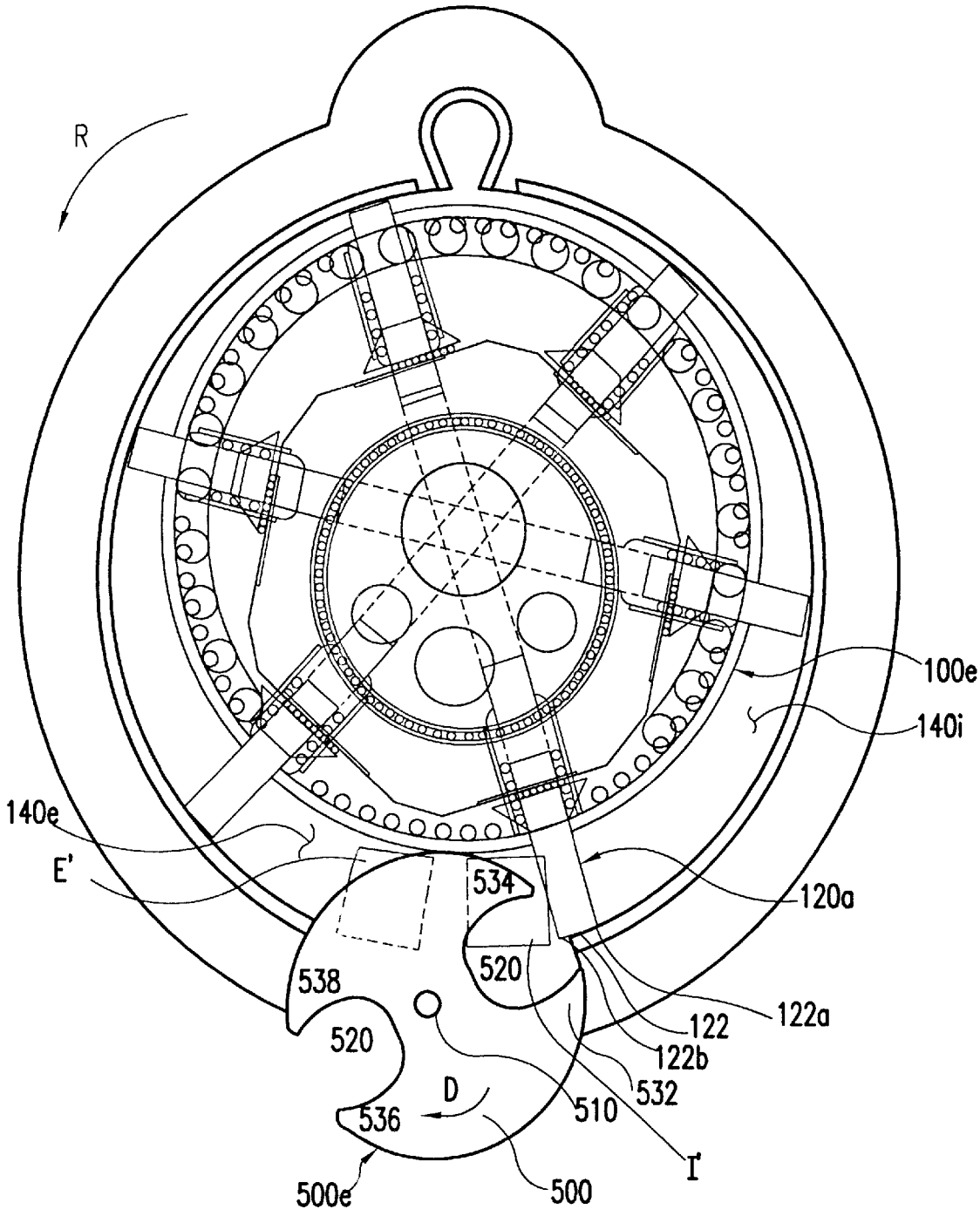

FIG. 4K illustrates the vane and rotary scavenging disk orientation when the departing vane is 20° past bottom dead center (bdc). In FIG. 4K, the leading tip portion 122*a* of the vane 120 breaks contact with the inner wall 535 of the recess 520 and the rotary scavenging disk seal projection 532. The vane tip 122 now contacts the stator cavity 210. In this configuration, the intake air begins to be compressed in the vane cell 140*i* as the vane 120 sweeps along the stator cavity 210. Again, the intake duct I' and the exhaust duct E' are separated from each other by the sealing proximity between the outer circumferential edge 500*e* of the rotary scavenging disk 500 and the outer circumferential edge 100*e* of the rotor 100.

Figure 4L:
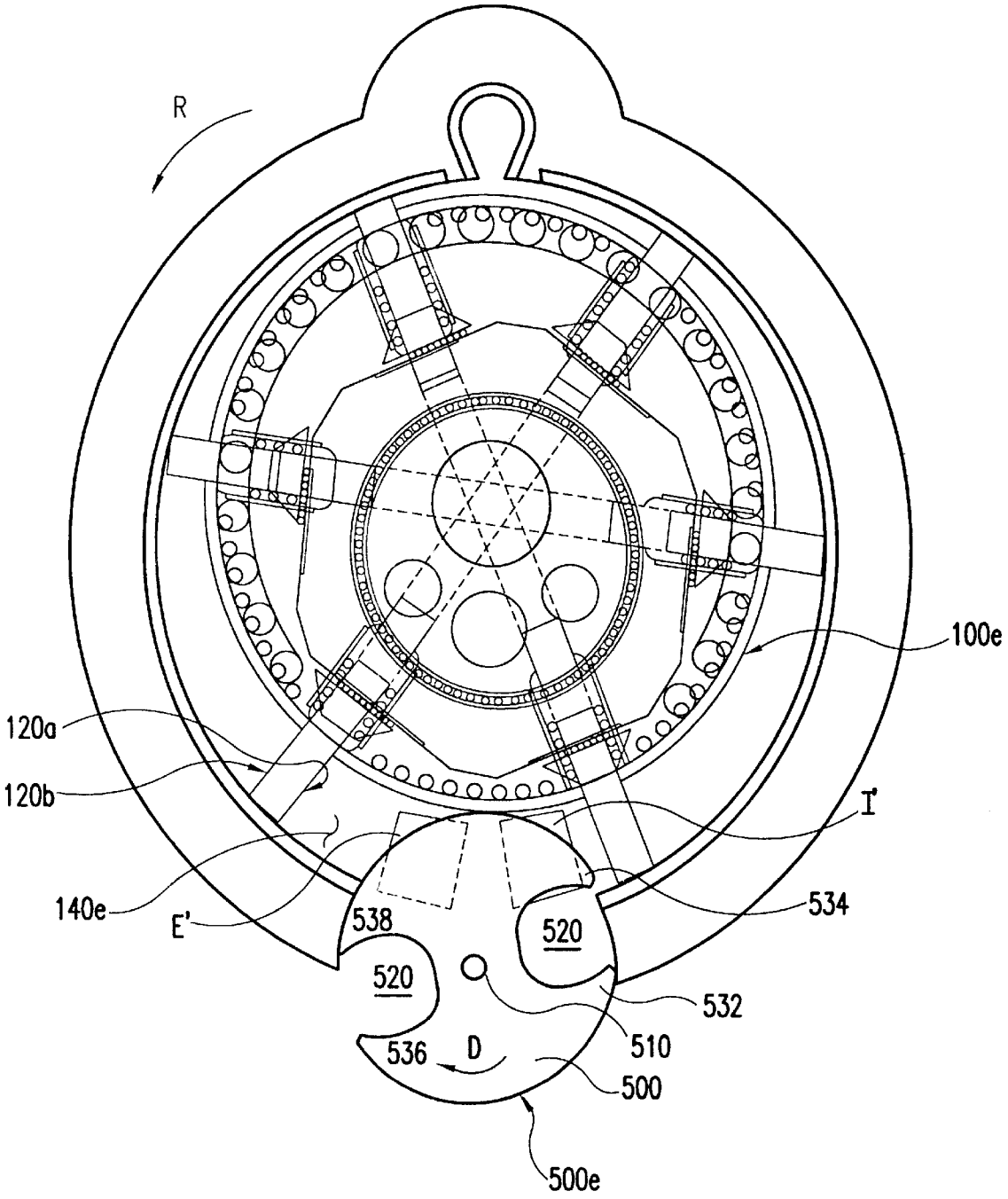

FIG. 4L illustrates the vane and rotary scavenging disk orientation when the departing vane is 25° past bottom dead center (bdc). Here, the seal projection 534 of the recess 520 is about to lose communication with the vane cell 140. The outer circumferential edge 500*e* of the rotary scavenging disk 500 still maintains sealing proximity with the outer circumferential edge 100*e* of the rotor 100 to separate the intake and exhaust regions.

Figure 4M:
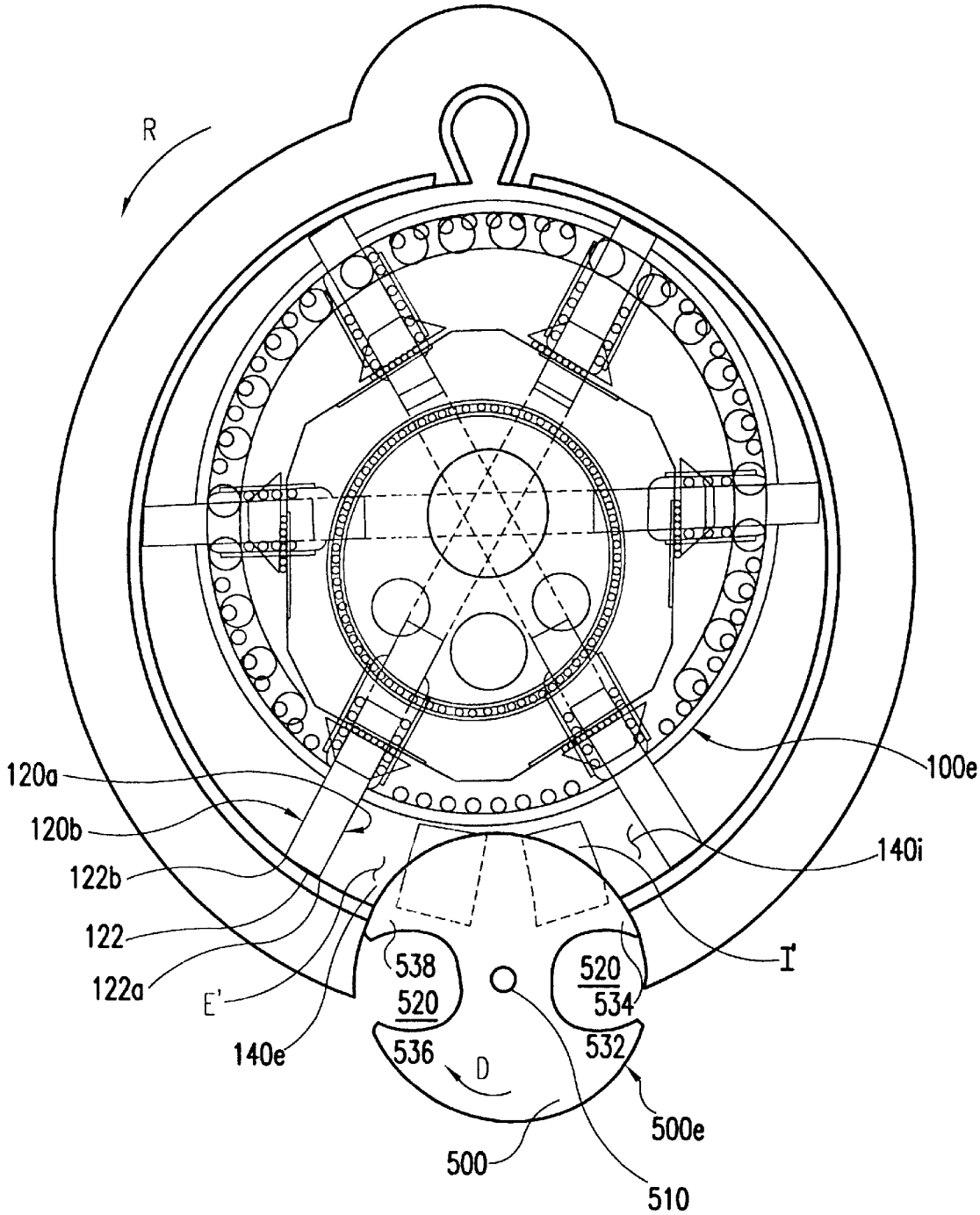

Finally, FIG. 4M is similar to FIG. 4A, which illustrates the vane and rotary scavenging disk orientation when the departing vane is 30° past bottom dead center (bdc). The outer circumferential edge 500*e* of the rotary scavenging disk 500 is in sealing proximity with the outer circumferential edge 100*e* of the rotor 100, and the recesses 520 are closed off from the vane cell 140. The cycle illustrated in FIGS. 4A through 4M is then repeated, except that the opposing rotary scavenging disk recess 520 communicates with the approaching vane 120.

The size of the disk, the location of the disk, and the axis of rotation of the disk, may all be varied so long as the flow separation is maintained between the intake duct I' and the exhaust duct E'. The embodiment in FIGS. 4A through 4M was described with reference to a certain sized intake duct I' and exhaust duct E'. One of ordinary skill in the art could readily understand that the size and shapes of the intake duct I' and the exhaust duct E' may be varied to optimize the intake and exhaust functions. By way of example, the intake duct I' and the exhaust duct E' may be triangular shaped, which as shown in FIG. 4A, would approximate the shape of the portions of the ducts that extend beyond the outer circumferential edge 500*e* of the rotary scavenging disk 500.

Moreover, the embodiment in FIGS. 4A through 4M was described with regard to a rectangular shaped vane 120 having two vane sealing tip portions 122*a*, 122*b* communicating with the rotary scavenging disk 500. It is understood that additional vane tip shapes, such as triangular or contoured, may be incorporated in the embodiments described above, perhaps with some slight modifications to the shape of the recess 520 to ensure proper sealing.

An infinite number of combinations of (a) number of recesses within the rotary scavenging disk, (b) diameter of rotary scavenging disk, (c) rotational speed of rotary scavenging disk, and (d) profile of rotary scavenging disk recesses are possible for a given application. The designer has the freedom to choose an optimum combination and persons skilled in the art of pumping machines, scavenging, and mechanical engineering could facilitate such an optimization without undue experimentation.

Figure 5:
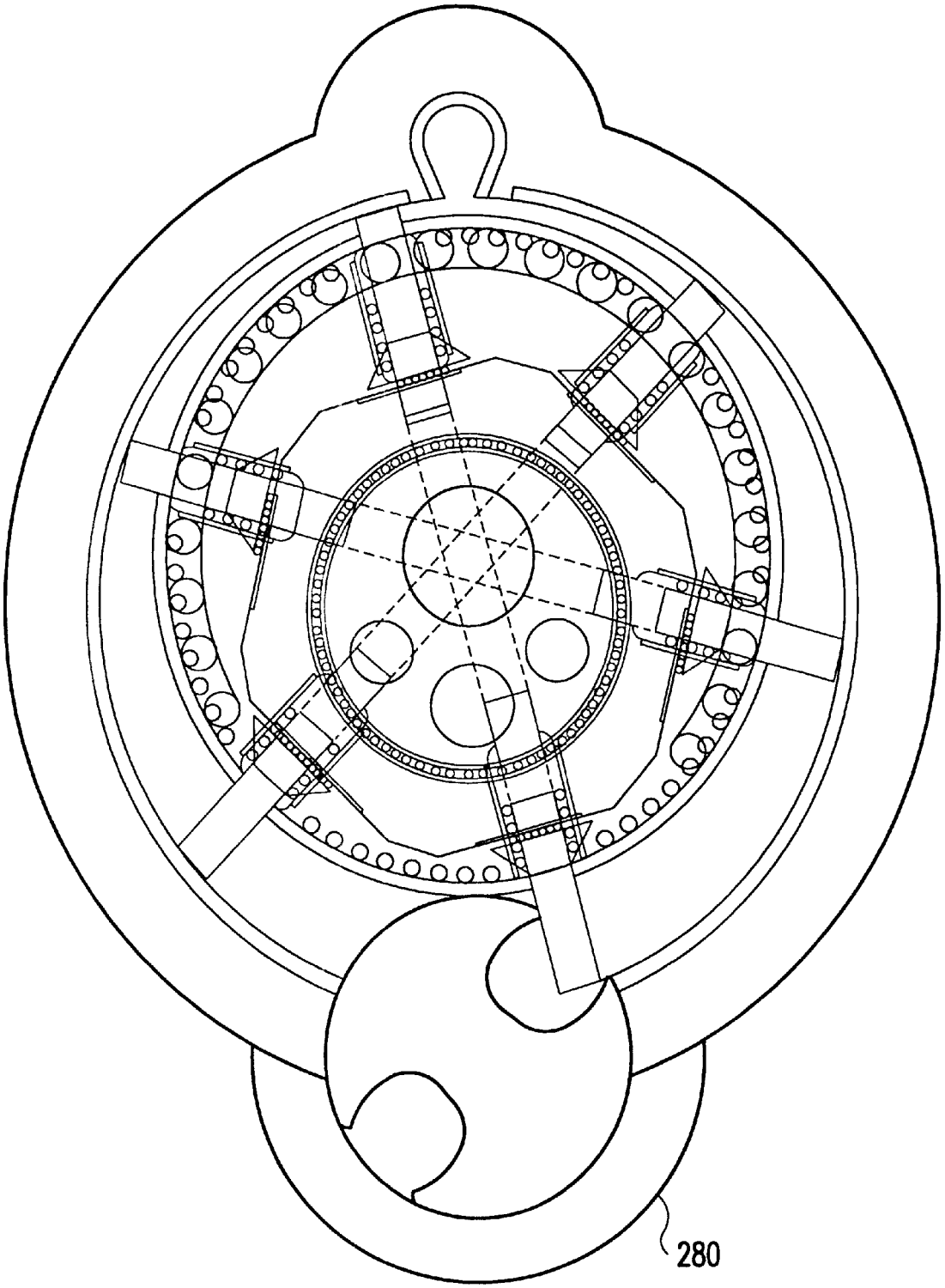
FIG. 5 is a side view of another embodiment of the rotary scavenging disk for the rotary-vane pumping machine in accordance with the present invention with an end plate removed.

Also, as shown in FIGS. 4A through 4M, while one of the rotary scavenging disk recesses 520 communicates with the approaching vane 120, the opposing rotary scavenging disk recess 520 communicates with an area external to the stator assembly 200. Depending on the particular requirements of the machine designer, the opposing rotary scavenging disk recess 520 may be utilized or not. For example, if one were to enclose or encase the area external to the stator assembly 200 where the opposing rotary scavenging disk recess 520 is located, using a housing 280 for example, as shown in FIG. 5, the opposing rotary scavenging disk recess 520 would be cut off from the ambient air or other air supply. In such a case, no other gas is in the recess 520 as it communicates with the vane cell 140, other than the small amount of exhaust gas that may have leaked around the vane tip portion 122 as described with reference to FIG. 4B. Most of this exhaust gas is eventually forced out into the exhaust duct E', although a small, insignificant portion may in turn leak into the intake vane cell 140*i*.

On the other hand, if a source of fresh air were provided to the enclosure 280, the rotary scavenging disk recess 520 communicating within the enclosure 280 would entrain a certain amount of fresh air within the recess 520. This fresh air within the recess 520 would thus be compressed as the approaching vane 120 interacts with the rotary scavenging disk 520 as shown in the sequence of FIGS. 4D through 4G. As the forward vane tip portion 122*a* progresses from the orientation shown in FIGS. 4G, the compressed air within the recess 520 could be injected into the intake vane cell 140*i* with the proper configuration. In effect, this charge of compressed air could be manipulated to provide a supercharging effect to the normal intake air charge. While the supercharging effect in such a case would be small, on the order of 10%–15%, it could provide some enhanced performance.

Various vents 600 (see FIG. 2) may be supplied in and around the rotary scavenging disk 500 to vent over-pressure and/or under-pressure in the recesses 520 to other locations. The over-pressure/under-pressure conditions result from the vane tips 122*a*, 122*b* and the azimuthal faces 120*a*, 120*b* both sealing against the inner walls 535 of the recesses 520 of the rotary scavenging disk 500 as the vane 120 sweeps through the recess 520. For example, the recesses 520 within the rotary scavenging disk 500 may be vented 600 to each other to maintain a more balanced pressure profile. In such an arrangement, the recess(es) 520 not in communication with a vane 120 may also be vented to ambient air or intake charge. Vents and scavenge ports may also be employed, positioned, and proportioned in a strategic manner to achieve a boost to the intake charge within the vane cell, thereby increasing power density.

Figure 6:
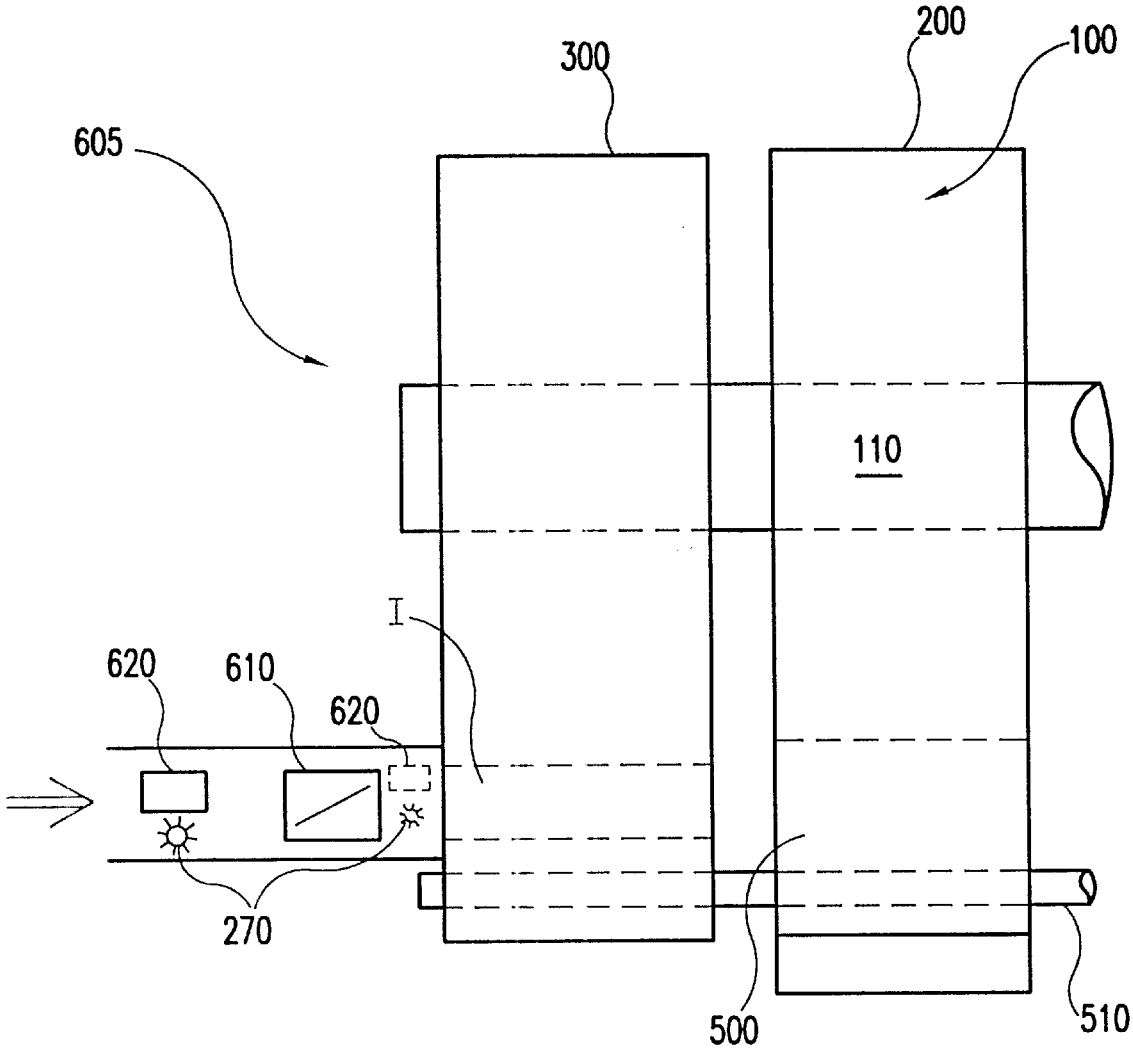
FIG. 6 is a simplified exploded schematic end view of a two-stroke internal combustion engine embodiment employing the rotary scavenging disk of the present invention.

FIG. 6 illustrates an exemplary embodiment of a two-stroke internal combustion vane engine 605 employing the rotary scavenging disk 500 as described herein. As shown, a throttle plate 610 is disposed in an intake manifold upstream of the rotary scavenging disk 500 to throttle the two-stroke engine. Note that the upstream direction is determined with reference to the flow stream arrow in the drawing. In addition, a carburetor 620, or fuel injection/induction device 270, may be disposed either upstream of the throttle plate 610 (solid lines in FIG. 6), at the approximate location of the throttle plate 610, or between the rotary scavenging disk 500 and the throttle plate 610 (phantom lines in FIG. 6).

The rotary scavenging disk 500 need not be placed at bottom dead center or maximum vane extension, but may be offset toward the exhaust or intake side of the cycle of an internal combustion engine application. In such a manner, cycle over-expansion or under-expansion may be achieved. For example, offsetting the rotary scavenging disk toward the intake side will achieve cycle over-expansion (expansion ratio greater than compression ratio) which tends to increase efficiency for a given compression ratio, though the power density will suffer somewhat. Offsetting towards the exhaust side will achieve cycle under-expansion (expansion ratio less than compression ratio). Cycle under-expansion could be used to increase power density by increasing cell volume at intake, though the efficiency will suffer somewhat. Thus, as can be seen, the flexibility of the rotary scavenging disk placement allows the engine designer to optimize the performance of the engine for a specific application.

It will be apparent to those skilled in the art that various modifications and variations can be made in the system and method of the present invention without departing from the spirit or scope of the invention. Thus, it is intended that the present invention cover the modifications and variations of this invention provided they come within the scope of the appended claims and their equivalents.

What is claimed is:

1. A rotary vane pumping machine comprising:

a stator assembly comprising an annular ring, the inner circumferential surface of the annular ring defining a contoured surface of a stator cavity;

a rotor spinning around a rotor shaft axis, the rotor shaft axis being a fixed rotational axis relative to the stator cavity, the rotor having a plurality of radial vane slots and the rotor and stator being in relative rotation;

a plurality of vanes, each of the plurality of vanes extending and retracting within a corresponding one of the radial vane slots of the rotor, wherein a pair of adjacent vanes defines a vane cell; and a rotary scavenging disk disposed along the annular ring and extending into the vane cell, wherein an outer circumferential edge of the rotary scavenging disk being in sealing proximity with an outer circumferential edge of the rotor, and wherein the rotary scavenging disk contains at least one recess formed along the outer circumferential edge thereof.

2. The rotary vane pumping machine of claim 1, further comprising a disk shaft extending through the annular ring of the stator assembly, about which the rotary scavenging disk spins.

3. The rotary vane pumping machine of claim 2, further comprising a disk shaft gear disposed along the disk shaft, and a rotor shaft gear disposed along the rotor shaft, wherein the disk shaft gear and rotor shaft gear mate to synchronize the rotation of the rotor and the rotary scavenging disk.

4. The rotary vane pumping machine of claim 1, wherein the at least one recess is defined by circumferentially spaced rotary scavenging disk seal projections along the outer circumferential edge thereof.

5. The rotary vane pumping machine of claim 4, wherein a vane tip portion of each vane selectively contacts and slides along an inner wall of the at least one recess as the vane extends and retracts within the corresponding one of the radial vane slots of the rotor.

6. The rotary vane pumping machine of claim 4, wherein an azimuthal face of each vane selectively contacts one of the rotary scavenging disk seal projections of the rotary scavenging disk as the vane extends and retracts within the corresponding one of the radial vane slots of the rotor.

7. The rotary vane pumping machine of claim 5, wherein an azimuthal face of each vane selectively contacts one of the rotary scavenging disk seal projections of the rotary scavenging disk as the vane extends and retracts within the corresponding one of the radial vane slots of the rotor.

8. The rotary vane pumping machine of claim 4, wherein the vane tip portion is rectangular and comprises a leading tip portion and a trailing tip portion, and wherein the trailing tip portion first contacts and slides along an inner wall of the at least one recess, and then the leading tip portion contacts and slides along the inner wall of the at least one recess.

9. The rotary vane pumping machine of claim 1, further comprising a plurality of recesses formed along the outer circumferential edge of the rotary scavenging disk, wherein each recess is alternatively brought into contact with the vane as the vane extends and retracts within the corresponding one of the radial vane slots of the rotor.

10. The rotary vane pumping machine of claim 9, further comprising a housing on the stator assembly enclosing the rotary scavenging disk.

11. The rotary vane pumping machine of claim 10, further comprising a fresh air pipe connected to the housing, wherein fresh air communicates with one of the recesses in the rotary scavenging disk.

12. The rotary vane pumping machine of claim 1, further comprising an intake port and an exhaust port communicating with the vane cells.

13. A two-stroke internal combustion vane engine comprising:

a stator assembly comprising an annular ring, the inner circumferential surface of the annular ring defining a contoured surface of a stator cavity;

a rotor spinning around a rotor shaft axis, the rotor shaft axis being a fixed rotational axis relative to the stator cavity, the rotor having a plurality of radial vane slots and the rotor and stator being in relative rotation;

a plurality of vanes, each of the plurality of vanes extending and retracting within a corresponding one of the radial vane slots of the rotor, wherein the plurality of vanes, the stator cavity, and the rotor defining a plurality of vane cells, the vane cells creating cascading volumes of intake, compression, combustion, expansion, and exhaust, to enable the two-stroke internal combustion engine; and a rotary scavenging disk disposed along the annular ring and extending into at least one of the vane cells, wherein an outer circumferential edge of the rotary scavenging disk being in sealing proximity with an outer circumferential edge of the rotor, wherein the rotary scavenging disk contains at least one recess formed along the outer circumferential edge thereof, and wherein each of the plurality of vanes sequentially meshes with the at least one recess to achieve at least one of scavenging and induction within the vane cells.

14. The two-stroke internal combustion vane engine of claim 13, further comprising a throttle plate disposed upstream of the rotary scavenging disk to throttle the two-stroke engine.

15. The two-stroke internal combustion vane engine of claim 14, further comprising a carburetor disposed upstream of the rotary scavenging disk.

16. The two-stroke internal combustion vane engine of claim 14, further comprising a fuel injector disposed upstream of the rotary scavenging disk.

* * * * *

UNITED STATES PATENT AND TRADEMARK OFFICE

CERTIFICATE OF CORRECTION

PATENT NO. : 6,244,240 B1
DATED : June 12, 2001
INVENTOR(S) : Mallen

It is certified that error appears in the above-identified patent and that said Letters Patent is hereby corrected as shown below:

Column 12,
Line 44, insert the following:
-- Although, as mentioned earlier in the specification, some dimensions of the drawings have been exaggerated and distorted, it should be understood that the rotor 100 and stator cavity 210 should be shown in the drawings as generally circular, and the distance between opposing vanes 120 should be shown to remain constant for the various opposing vane pairs. --

Signed and Sealed this

Ninth Day of April, 2002

*Attest:*

*Attesting Officer*

JAMES E. ROGAN
*Director of the United States Patent and Trademark Office*